US008573163B2

(12) United States Patent
Kinomura et al.

(10) Patent No.: US 8,573,163 B2
(45) Date of Patent: Nov. 5, 2013

(54) COOLING DEVICE FOR VEHICLE

(75) Inventors: Shigeki Kinomura, Shizuoka-ken (JP); Tatsuki Saito, Susono (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 13/131,448

(22) PCT Filed: Oct. 5, 2009

(86) PCT No.: PCT/JP2009/067333
§ 371 (c)(1),
(2), (4) Date: May 26, 2011

(87) PCT Pub. No.: WO2011/042942
PCT Pub. Date: Apr. 14, 2011

(65) Prior Publication Data

US 2012/0137992 A1 Jun. 7, 2012

(51) Int. Cl.
*F01P 7/14* (2006.01)

(52) U.S. Cl.
USPC ..... 123/41.08; 123/41.02; 123/41.29; 237/5

(58) Field of Classification Search
USPC ..... 123/41.08, 41.02, 41.29; 237/5
See application file for complete search history.

(56) References Cited

U.S. PATENT DOCUMENTS

| | | | | |
|---|---|---|---|---|
| 4,605,164 | A * | 8/1986 | Hayashi et al. | 237/2 A |
| 5,910,099 | A * | 6/1999 | Jordan et al. | 60/599 |
| 6,837,192 | B2 * | 1/2005 | Shinpo et al. | 123/41.1 |
| 6,928,962 | B2 * | 8/2005 | Yamazaki | 123/41.05 |
| 7,263,954 | B2 * | 9/2007 | Piddock et al. | 123/41.09 |
| 7,363,804 | B2 * | 4/2008 | Wakahara et al. | 73/114.39 |
| 7,421,984 | B2 * | 9/2008 | Braun et al. | 123/41.29 |
| 7,655,098 | B2 * | 2/2010 | Shih et al. | 134/169 A |
| 2009/0295158 | A1 * | 12/2009 | Yuri | 290/2 |

FOREIGN PATENT DOCUMENTS

| | | |
|---|---|---|
| JP | A-58-47385 | 3/1983 |
| JP | U-59-152134 | 10/1984 |
| JP | A-2003-184556 | 7/2003 |
| JP | A-2008-208716 | 9/2008 |
| JP | A-2009-150266 | 7/2009 |

OTHER PUBLICATIONS

Notice of Allowance dated Nov. 8, 2011 in Japanese Patent Application No. 2010-546172 (with translation).
International Search Report dated Dec. 22, 2009 in International Application No. PCT/JP2009/067333.

* cited by examiner

*Primary Examiner* — Thanh K Truong
*Assistant Examiner* — Omar Morales
(74) *Attorney, Agent, or Firm* — Oliff & Berridge, PLC

(57) ABSTRACT

When the temperature of coolant in an engine is greater than or equal to a half-warm-up determination value, an engine cooling control section opens a valve to mix the coolant in two coolant circuits. Accordingly, even if the temperature of the coolant in the engine fluctuates due to mixing coolants at different temperatures, such fluctuation occurs in a temperature range lower than the determination value for the warm-up completion of the engine. This prevents a control procedure for the time before the warm-up completion and a control procedure for the time after such completion from being performed in a repeating, alternating manner. As a result, when the coolant circulating in the first coolant circuit and the coolant circulating in the second coolant circuit are mixed together, control that should be performed based on the coolant temperature in the engine is carried out without hindrance.

10 Claims, 12 Drawing Sheets

| Engine State | Coolant in Engine | Valve | Thermostat |
|---|---|---|---|
| Cold | Stopped | Closed | Closed |
| Half-Warmed-Up | Circulated | Open | Closed |
| Warmed-Up | Circulated | Open | Open |

COOLING DEVICE FOR VEHICLE

FIELD OF THE INVENTION

The present invention relates to a cooling apparatus for a vehicle.

BACKGROUND OF THE INVENTION

Conventionally, a cooling apparatus for a vehicle having a first coolant circuit, in which coolant circulates through an engine, and a second coolant circuit, in which the coolant circulates without passing through the engine, has been proposed. This arrangement allows coolant to flow independently in the respective first and second coolant circuits. Specifically, in the cooling apparatus, the first coolant circuit is used to cool the engine, and the second coolant circuit is employed to recover exhaust heat from the engine and heat the passenger compartment, as described in, for example, Patent Document 1.

FIG. 19 represents the configuration of the cooling apparatus described in Patent Document 1. The coolant in the first coolant circuit of the cooling apparatus is sent from a first water pump 52 and flows through the interior of an engine 50. The coolant then reaches a radiator 53 downstream from the engine 50, which radiates heat from the coolant. Afterwards, the coolant returns to the first water pump 52 via a thermostat 54. The thermostat 54, which is arranged in the first coolant circuit, operates in response to the temperature of the coolant flowing into the thermostat 54 to selectively prohibit and permit flow of the coolant through the radiator 53. The coolant circulating in the second coolant circuit is pumped out from a second water pump 55 and flows through a heater core 56, an exhaust heat recovery device 51, and a three-way valve 57 before returning to the second water pump 55. The heater core 56 heats air to be sent into the passenger compartment using the heat produced by the coolant. The exhaust heat recovery device 51 exchanges heat with exhaust gas from the engine 50 to recover the heat from the exhaust gas. The three-way valve 57 regulates the flow of the coolant. A coolant temperature sensor 60 is arranged in the second coolant circuit and detects the temperature of the coolant at a position downstream from the second water pump 55. The first coolant circuit and the second coolant circuit are connected to each other through a coolant passage 58 and a coolant passage 59. The coolant passage 58 connects the downstream side of the engine 50 to the three-way valve 57. The coolant passage 59 connects the downstream side of the exhaust heat recovery device 51 to the thermostat 54.

In this conventional cooling device for a vehicle, the thermostat 54 closes when the temperature of the coolant flowing into the thermostat 54 is low to block the coolant flow through the thermostat 54. The three-way valve 57 is controlled in correspondence with the temperature detected by the coolant temperature sensor 60. When the detected temperature is low, the three-way valve 57 connects the exhaust heat recovery device 51 to the second water pump 55. When the detected temperature is high, the three-way valve 57 connects the engine 50 to the second water pump 55. The first water pump 52 is controlled in correspondence with the temperature detected by the coolant temperature sensor 60 and stopped when the detected temperature is low.

In FIG. 20, the arrows represent the coolant flow at the time when the temperature of the coolant at the position downstream from the second water pump 55, which is detected by the coolant temperature sensor 60, is low. In this state, the thermostat 54 is closed and the three-way valve 57 operates to connect the exhaust heat recovery device 51 to the second water pump 55. This separates the first coolant circuit from the second coolant circuit. Further, in this state, the first water pump 52 is stopped and the second water pump 55 is operated solely. Accordingly, in the cooling apparatus of the vehicle, the coolant circulates only in the second coolant circuit. Specifically, the coolant flows from the second water pump 55 to the heater core 56 and the exhaust heat recovery device 51 and returns to the second water pump 55. On the other hand, the engine 50 retains coolant that is prevented from circulating. This causes a temperature rise in the coolant and thus promotes warm-up of the engine 50. If, in this state, the passenger compartment is heated, the coolant heated by the heat from the exhaust gas in the exhaust heat recovery device 51 is sent to the heater core 56. As a result, the air discharged into the passenger compartment is heated by the heat of the exhaust gas recovered by the exhaust heat recovery device 51.

In contrast, in FIG. 21, the arrows represent the coolant flow at the time when the coolant temperature at the position downstream from the second water pump 55, which is detected by the coolant temperature sensor 60, is high. In this state, the thermostat 54 is opened and the three-way valve 57 operates to connect the engine 50 to the second water pump 55. The first water pump 52 and the second water pump 55 are both in operation. As a result, in the cooling apparatus for a vehicle, a first circulation loop and a second circulation loop, as will be described below, are formed as two circulation loops for the coolant. The first circulation loop extends from the first water pump 52, proceeds through the interior of the engine 50, the radiator 53, and the thermostat 54, and returns to the first water pump 52. The second circulation loop branches from the first circulation loop after the coolant has passed through the engine 50. The second circulation loop extends through the second water pump 55, the heater core 56, and the exhaust heat recovery device 51 and remerges with the second circulation loop at the thermostat 54. At this stage, the coolant in the first coolant circuit is mixed with the coolant in the second coolant circuit. Accordingly, if the coolant in the second coolant circuit has been sufficiently heated by the heat from the exhaust gas in the exhaust heat recovery device 51 by the time when the coolant is mixed with the coolant in the first circulation loop, the coolant flowing into the engine 50 is heated through the coolant mixing, which promotes warm-up of the engine 50.

PRIOR ART DOCUMENT

Patent Document

Patent Document 1
Japanese Laid-Open Patent Publication No 2008-208716

SUMMARY OF THE INVENTION

However, in some circumstances, the above-described conventional cooling device for a vehicle may cause a problem in terms of engine control as described below after the coolant mixing.

In the conventional cooling device for a vehicle, heating of the coolant of the first coolant circuit in the engine 50 by the heat generated by the engine 50 is started immediately after start-up of the engine 50 is initiated. Accordingly, in some cases, the temperature of the coolant in the second coolant circuit may be lower than the temperature of the coolant of the first coolant circuit in the engine 50 when the coolants are mixed together. In these cases, once the coolants from both coolant circuits start to mix, the coolant from the second coolant circuit, which is cooler, merges into the flow of the coolant circulating via the engine 50. This may cause an uneven temperature distribution in the coolant passing through the engine 50 under some conditions, thus destabilizing the temperature of the coolant flowing through the engine 50.

In many control procedures for the engine 50, the content of the control procedure for the time before completion of engine warm-up is different from the content of the procedure for the time after such completion. Accordingly, as represented in FIG. 22, if the temperature of the coolant passing through the engine 50 is unstable and fluctuates around a determination value (which is, for example, 90° C.) for the completion of the engine warm-up after the coolants from the two coolant circuits are mixed together, "hunting" occurs in engine control. In other words, the control for the time before the completion of the engine warm-up and the control for the time after such completion are performed in a repeating, alternating manner. As has been described, in the conventional cooling apparatus for a vehicle, the coolant in the engine 50 in a sufficiently heated state may be mixed with the cooler coolant, thus causing a problem in performing control based on the coolant temperature.

Accordingly, it is an objective of the present invention to provide a cooling apparatus for a vehicle capable of performing, without hindrance, control based on the temperature of coolant at the side corresponding to an engine when the coolant circulating in a first coolant circuit is mixed with the coolant circulating in a second coolant circuit.

To achieve the foregoing objective, a cooling apparatus for a vehicle according to the present invention includes a first coolant circuit in which coolant circulates through an engine and a second coolant circuit in which coolant circulates without passing through the engine. The cooling apparatus further includes a valve and a valve control section. When closed, the valve decreases or zeroes out the flow rate of the coolant in the first coolant circuit that passes through the engine. When open, the valve mixes the coolant in the first coolant circuit and the coolant in the second coolant circuit. The valve control section closes the valve when the temperature of the coolant in the first coolant circuit is less than a half-warm-up determination value set to a value lower than a determination value for warm-up completion of the engine. The valve control section opens the valve when the temperature of the coolant in the first coolant circuit increases to the half-warm-up determination value or higher. When the temperature of the coolant in the first coolant circuit is greater than or equal to the half-warm-up determination value, it is determined that a closed valve failure has occurred in the valve if the difference between the temperature of the coolant in the first coolant circuit and the temperature of the coolant in the second coolant circuit is greater than a failure determination value.

In the above-described configuration, by closing the valve, the flow rate of the coolant flowing through the engine may be reduced or zeroed out, thus advancing warm-up of the engine. However, if the valve is closed at the time of start-up of the engine, the coolant of the first coolant circuit in the engine is heated quickly. This may advance a temperature rise in the coolant in the first coolant circuit compared to a temperature rise in the coolant in the second coolant circuit. In this case, if the coolant in the second coolant circuit at a lower temperature is mixed with the coolant in the first coolant circuit with the temperature of the coolant in the engine exceeding the determination value for the warm-up completion of the engine, which may cause uneven temperature distribution of the coolant in the engine, thus destabilizing the coolant temperature in the engine. This may cause fluctuation of the coolant temperature in the engine around the determination value for the warm-up completion of the engine. In this case, a problem may occur in control for switching control contents depending on whether or not the coolant temperature in the engine is higher than or equal to the determination value for the warm-up completion.

However, in this configuration, when the temperature of the coolant of the first coolant circuit in the engine rises to the half-warm-up determination value, which is set to a value lower than the determination value for the engine warm-up completion, or higher, the valve is opened to mix the coolants in the two coolant circuits. Accordingly, even if the coolant in the first coolant circuit is mixed with the coolant in the second coolant circuit at the lower temperature and thus the coolant temperature in the engine fluctuates, such fluctuation happens in a temperature range lower than the determination value for the engine warm-up completion. This prevents a control procedure for the time before the warm-up completion and a control procedure for the time after such completion from being carried out in a repeating, alternating manner. As a result, the configuration ensures execution without hindrance of control based on the coolant temperature in the engine when the coolant circulating in the first coolant circuit and the coolant circulating in the second coolant circuit are mixed.

If the valve is stuck closed, or, in other words, a closed valve failure occurs in the valve, the flow rate of the coolant in the first coolant circuit is maintained to be reduced or zeroed out regardless of the temperature of the coolant in the first coolant circuit. This may hamper effective cooling of the engine with the coolant, thus causing the engine to overheat. To prevent the engine overheating caused by a closed valve failure of the valve, a closed valve failure must be detected quickly after a closed valve failure has occurred in the valve. In this regard, according to the above-described configuration, when the coolant temperature in the first coolant circuit is higher than or equal to the half-warm-up determination value, it is determined that a closed valve failure has occurred in the valve if the difference between the temperature of the coolant in the first coolant circuit and the temperature of the coolant in the second coolant circuit. This ensures early detection of a closed valve failure of the valve, thus preventing the engine overheating from being caused by a closed valve failure.

In accordance with one aspect of the present invention, when the temperature of the coolant in the first coolant circuit is less than the half-warm-up determination value, the cooling apparatus obtains an estimate of the temperature of the coolant in the first coolant circuit based on an engine operating state since start-up initiation and obtains an actual measurement value of the temperature of the coolant in the first coolant circuit from a detection signal provided by a coolant temperature sensor for detecting the temperature of the coolant in the first coolant circuit. The apparatus determines that an open valve failure has occurred in the valve if the difference between the estimate and the actual measurement value is greater than or equal to the failure determination value.

When the valve is stuck open, or, in other words, an open valve failure occurs in the valve, the valve is maintained open to cause the coolant in the first coolant circuit to flow through the engine by a large amount. This may retard the engine warm-up and thus degrade the fuel efficiency. To solve the retarded warm-up and the degraded fuel efficiency of the engine, which are caused by the open valve failure of the valve, the open valve failure must be detected quickly after the open valve failure has occurred in the valve. In the above-described configuration, based on the fact that the estimate of the coolant temperature in the first coolant circuit increases with the actual measurement value of such coolant temperature maintained low when the valve has the open valve failure, the open valve failure is determined to have occurred in the valve if the difference between the estimate and the actual measurement value of the coolant temperature in the first coolant circuit is greater than or equal to the failure determination value. As a result, the open valve failure is detected in the valve quickly after the open valve failure has occurred, thus coping with the retarded warm-up and the degraded fuel efficiency of the engine caused by the open valve failure of the valve.

In accordance with one aspect of the present invention, the cooling apparatus for a vehicle includes a radiator and a thermostat. The radiator radiates heat from the coolant that has passed through the engine. The thermostat closes to prohibit circulation of the coolant through the radiator when the temperature of the coolant is less than a prescribed value. The thermostat opens to permit the circulation of the coolant in the first coolant circuit through the radiator when the temperature of the coolant is higher than or equal to the prescribed value. The cooling apparatus forcibly opens the thermostat when it is determined that a closed valve failure has occurred in the valve.

In the above-described configuration, when it is determined that the valve has a closed valve failure, the thermostat is forcibly opened to permit the circulation of the coolant in the first coolant circuit via the radiator. This causes a large amount of coolant to flow through the engine and the radiator to radiate heat from the coolant that has passed through the engine. Accordingly, even if a closed valve failure has occurred in the valve, overheating of the engine is prevented from being caused by the closed valve failure.

In accordance with one aspect of the present invention, when it is determined that a closed valve failure has occurred in the valve, the cooling apparatus forcibly opens the thermostat on condition that the temperature of the coolant in the first coolant circuit is higher than or equal to a valve opening value that is smaller than the prescribed value.

In the above-described configuration, forcible opening of the thermostat is performed appropriately on the condition that the temperature of the coolant in the first coolant circuit is greater than or equal to the valve opening value, that is, a condition is met that necessitates prevention of engine overheating. As a result, the forcible opening of the thermostat is prevented from being carried out unnecessarily and the engine is prevented from being overheated due to a closed valve failure of the valve.

In accordance with one aspect of the present invention, when it is determined that a closed valve failure has occurred in the valve, the cooling apparatus prohibits operation of the engine.

In the above-described configuration, when it is determined that the valve has a closed valve failure, operation of the engine is prohibited and thus heat generation by the engine is suspended. This prevents the engine from being overheated through the heat generation by the engine caused by a closed valve failure of the valve.

In accordance with one aspect of the present invention, the cooling apparatus for a vehicle includes a radiator and a thermostat. The radiator radiates heat from the coolant that has passed through the engine. The thermostat closes to prohibit circulation of the coolant through the radiator when the temperature of the coolant is less than a prescribed value. The thermostat opens to permit the circulation of the coolant in the first coolant circuit through the radiator when the temperature of the coolant is higher than or equal to the prescribed value. When it is determined that a closed valve failure has occurred in the valve, the cooling apparatus prohibits the operation of the engine on condition that the temperature of the coolant in the first coolant circuit is higher than or equal to the prescribed value.

In the above-described configuration, the operation of the engine is prohibited appropriately on the condition that the coolant temperature in the first coolant circuit is higher than or equal to the prescribed value, that is, a condition that necessitates prevention of engine overheating is met. As a result, prohibition of the engine operation is prevented from being performed unnecessarily and the engine is prevented from being overheated due to a closed valve failure of the valve.

In accordance with one aspect of the present invention, the cooling apparatus for a vehicle further includes an electric pump arranged in the first coolant circuit to circulate the coolant in the first coolant circuit. If the discharge flow rate of the electric pump is increased to a value greater than a normal usage range, the valve allows to send the coolant of a flow rate necessary for cooling the engine even when the valve is closed. When it is determined that a closed valve failure has occurred in the valve, the discharge flow rate of the electric pump is increased to a value greater than the normal usage range.

In the above-described configuration, when it is determined that a closed valve failure has occurred in the valve, the discharge flow rate of the electric pump is increased to a value greater than the normal usage range. This causes the coolant of the flow rate necessary for cooling the engine to flow through the valve even when the valve is closed. The aforementioned flow rate of coolant thus passes through the engine. As a result, even when the valve has a closed valve failure, the engine is prevented from being overheated due to the closed valve failure.

In accordance with one aspect of the present invention, the cooling apparatus for a vehicle further includes an electric pump, a detour passage, and a west gate valve. The electric pump is arranged in the first coolant circuit to circulate the coolant in the first coolant circuit. The detour passage is arranged in the first coolant circuit in such a manner as to detour the valve. The west gate valve is opened to send the coolant of the flow rate necessary for cooling the engine via the detour passage when the discharge flow rate of the electric pump is increased to a value greater than a normal usage range. When it is determined that a closed valve failure has occurred in the valve, the cooling apparatus increases the discharge flow rate of the electric pump to a value greater than the normal usage range.

In the above-described configuration, when it is determined that a closed valve failure has occurred in the valve, the discharge flow rate of the electric pump is increased to a value greater than the normal usage range to open a west gate valve in the detour passage. This causes the coolant of the flow rate necessary for cooling the engine to flow via the detour passage even when the valve has a closed valve failure. The aforementioned flow rate of coolant thus passes through the engine. As a result, even when the valve has a closed valve failure, the engine is prevented from being overheated due to the closed valve failure.

In accordance with another aspect of the present invention, a cooling apparatus for a vehicle includes a first coolant circuit in which coolant circulates through an engine and a second coolant circuit in which coolant circulates without passing through the engine. The cooling apparatus further includes a valve, a first coolant temperature sensor, a second coolant temperature sensor, and a valve control section. When closed, the valve decreases or zeroes out the flow rate of the coolant in the first coolant circuit that passes through the engine. When open, the valve mixes the coolant in the first coolant circuit and the coolant in the second coolant circuit. The first coolant temperature sensor detects the temperature of the coolant in the first coolant circuit. The second coolant temperature sensor detects the temperature of the coolant in the second coolant circuit. The valve control section closes the valve when the temperature of the coolant in the first coolant circuit is less than a half-warm-up determination value set to a value lower than a determination value for warm-up completion of the engine. The valve control section opens the valve when the temperature of the coolant in the first coolant circuit increases to the half-warm-up determination value or higher. If a failure has occurred in one of the first coolant temperature sensor and the second coolant temperature sensor, the valve control section opens the valve to mix the coolant in the first coolant circuit with the coolant in the second coolant circuit.

In the above-described configuration, by closing the valve, the flow rate of the coolant flowing through the engine may be reduced or zeroed out, thus advancing warm-up of the engine. However, if the valve is closed at the time of start-up of the engine, the coolant of the first coolant circuit in the engine is heated quickly. This may advance a temperature rise in the coolant in the first coolant circuit compared to a temperature rise in the coolant in the second coolant circuit. In this case, if the coolant in the second coolant circuit at a lower temperature is mixed with the coolant in the first coolant circuit with the temperature of the coolant in the engine exceeding the determination value for the warm-up completion of the engine, which may cause uneven temperature distribution of the coolant in the engine, thus destabilizing the coolant temperature in the engine. This may cause fluctuation of the coolant temperature in the engine around the determination value for the warm-up completion of the engine. In this case, a problem may occur in control that switches control contents depending on whether or not the coolant temperature in the engine is higher than or equal to the determination value for the warm-up completion.

However, in this configuration, when the temperature of the coolant of the first coolant circuit in the engine rises to the half-warm-up determination value, which is set to a value lower than the determination value for the engine warm-up completion, or higher, the valve is opened to mix the coolants in the two coolant circuits. Accordingly, even if the coolant in the first coolant circuit is mixed with the coolant in the second coolant circuit at the lower temperature and thus the coolant temperature in the engine fluctuates, such fluctuation happens in a temperature range lower than the determination value for the engine warm-up completion. This prevents a control procedure for the time before the warm-up completion and a control procedure for the time after such completion from being carried out in a repeating, alternating manner. As a result, the configuration ensures execution without hindrance of control based on the coolant temperature in the engine when the coolant circulating in the first coolant circuit and the coolant circulating in the second coolant circuit are mixed.

If one of the two coolant temperature sensors has a failure, the coolant temperature detected by the malfunctioning one of the coolant temperature sensors does not reflect the actual coolant temperature. This hampers appropriate execution of various controls performed based on the coolant temperature detected by the malfunctioning coolant temperature sensor. To solve this problem, in the above-described configuration, when one of the two coolant temperature sensors has a failure, the valve is opened to permit communication between the first coolant circuit and the second coolant circuit, thus mixing the coolant in the first coolant circuit and the coolant in the second coolant circuit. In this manner, the coolant temperature detected by the malfunctioning coolant temperature sensor approximates to the coolant temperature detected by the normally functioning coolant temperature sensor. The coolant temperature detected by the malfunctioning coolant temperature sensor may thus be replaced by the coolant temperature detected by the normally functioning coolant temperature sensor. As a result, if a failure has occurred in one of the two coolant temperature sensors, the coolant temperature detected by the malfunctioning one of the coolant temperature sensors may be replaced by the coolant temperature detected by the normally functioning one of the coolant temperature sensors, and the various controls are carried out based on the replacement coolant temperature.

In accordance with a further aspect of the present invention, a cooling apparatus for a vehicle includes a first coolant circuit in which coolant circulates through an engine and a second coolant circuit in which coolant circulates without passing through the engine. The cooling apparatus further includes a valve, a coolant temperature sensor, a coolant temperature estimating section, and a valve control section. When closed, the valve decreases or zeroes out the flow rate of the coolant in the first coolant circuit that passes through the engine. When open, the valve mixes the coolant in the first coolant circuit and the coolant in the second coolant circuit. The coolant temperature sensor detects the temperature of the coolant in one of the first coolant circuit and the second coolant circuit. The coolant temperature estimating section estimates the temperature of the coolant in the other one of the first coolant circuit and the second coolant circuit. The valve control section closes the valve when the temperature of the coolant in the first coolant circuit is less than a half-warm-up determination value set to a value lower than a determination value for warm-up completion of the engine. The valve control section opens the valve when the temperature of the coolant in the first coolant circuit increases to the half-warm-up determination value or higher. If a failure has occurred in the coolant temperature sensor, the valve control section opens the valve to mix the coolant in the first coolant circuit and the coolant in the second coolant circuit.

In the above-described configuration, by closing the valve, the flow rate of the coolant flowing through the engine may be reduced or zeroed out, thus advancing warm-up of the engine. However, if the valve is closed at the time of start-up of the engine, the coolant of the first coolant circuit in the engine is heated quickly. This may advance a temperature rise in the coolant in the first coolant circuit compared to a temperature rise in the coolant in the second coolant circuit. In this case, if the coolant in the second coolant circuit at a lower temperature is mixed with the coolant in the first coolant circuit with the temperature of the coolant in the engine exceeding the determination value for the warm-up completion of the engine, which may cause uneven temperature distribution of the coolant in the engine, thus destabilizing the coolant temperature in the engine. This may cause fluctuation of the coolant temperature in the engine around the determination value for the warm-up completion of the engine. In this case, a problem may occur in control that switches control contents depending on whether or not the coolant temperature in the engine is higher than or equal to the determination value for the warm-up completion.

However, in this configuration, when the temperature of the coolant of the first coolant circuit in the engine rises to the half-warm-up determination value, which is set to a value lower than the determination value for the engine warm-up completion, or higher, the valve is opened to mix the coolants in the two coolant circuits. Accordingly, even if the coolant in the first coolant circuit is mixed with the coolant in the second coolant circuit at the lower temperature and thus the coolant temperature in the engine fluctuates, such fluctuation happens in a temperature range lower than the determination value for the engine warm-up completion. This prevents a control procedure for the time before the warm-up completion and a control procedure for the time after such completion from being carried out in a repeating, alternating manner. As a result, the configuration ensures execution without hindrance of control based on the coolant temperature in the engine when the coolant circulating in the first coolant circuit and the coolant circulating in the second coolant circuit are mixed.

If the coolant temperature sensor has a failure, the coolant temperature detected by the coolant temperature sensor does not reflect the actual coolant temperature. This hampers appropriate execution of various controls performed based on the coolant temperature detected by the coolant temperature sensor. To solve this problem, in the above-described configuration, when the coolant temperature sensor has a failure, the valve is opened to permit communication between the first coolant circuit and the second coolant circuit, thus mixing the coolant in the first coolant circuit and the coolant in the second coolant circuit. In this, manner, the coolant temperature detected by the coolant temperature sensor approximates to the coolant temperature estimated by the coolant temperature estimating section. The coolant temperature detected by the coolant temperature sensor may thus be replaced by the coolant temperature estimated by the coolant temperature estimating section. As a result, if a failure has occurred in the coolant temperature sensor, the coolant temperature detected by the coolant temperature sensor may be replaced by the coolant temperature estimated by the coolant temperature estimating section, and the various controls are carried out based on the replacement coolant temperature.

DETAILED DESCRIPTION OF THE PREFERRED EMBODIMENTS

First Embodiment

A first embodiment of the present invention, which is a cooling apparatus for a vehicle, will now be described with reference to FIGS. 1 to 8.

Figures 1, 2:
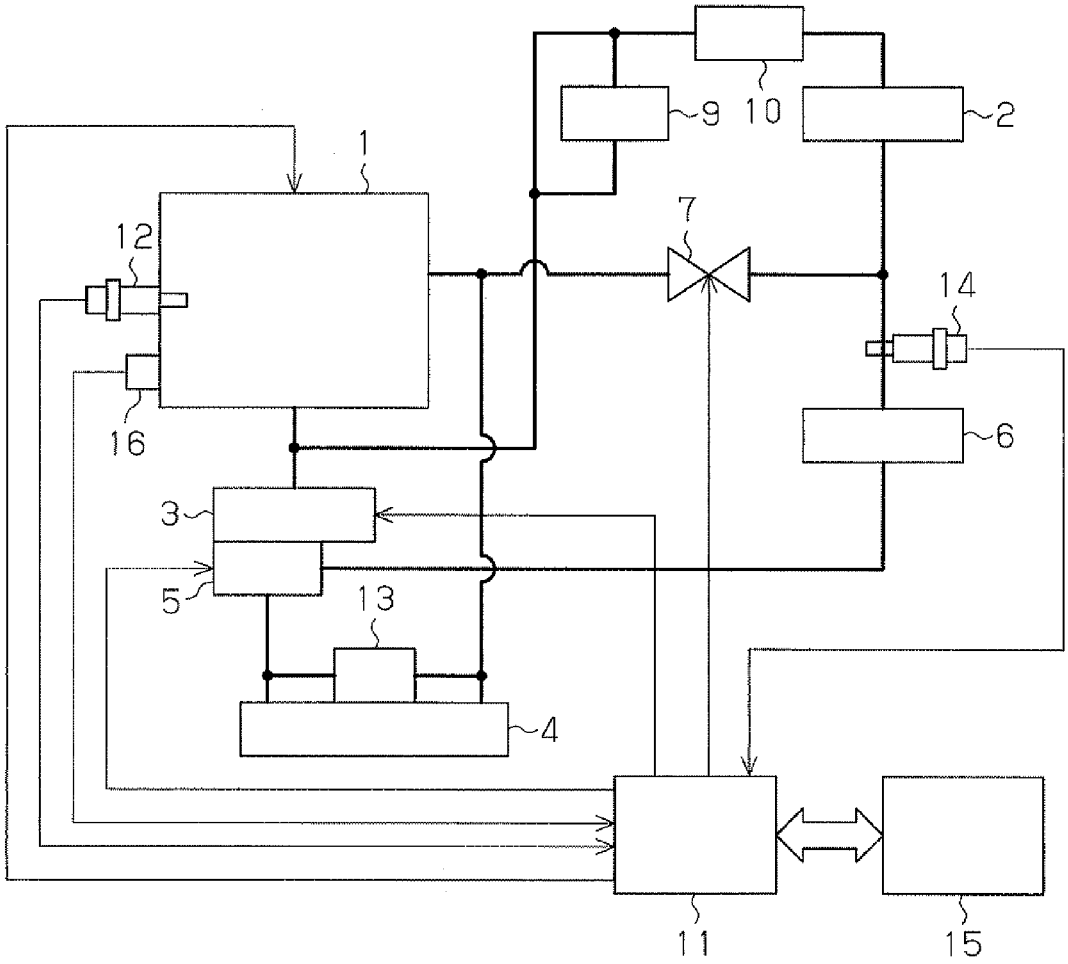
FIG. 1 is a block diagram schematically illustrating the configuration of a first embodiment of a cooling apparatus for a vehicle, as a whole, according to the present invention.
FIG. 2 is a table representing the circulating state of engine coolant, the operating state of a valve, and the operating state of a thermostat in the cooling apparatus for a vehicle of the first embodiment in correspondence with different warm-up states of an engine.

FIG. 1 illustrates the configuration of coolant circuits formed in あ cooling apparatus for a vehicle of the first embodiment. The cooling apparatus includes a first coolant circuit, in which coolant circulates through the engine 1, and a second coolant circuit, in which coolant circulates via an exhaust heat recovery device 2 without passing through the engine 1. A common water pump 3 sends coolant into the respective coolant circuits. The water pump 3 is an electric pump and varies the flow rate of the coolant sent by the water pump 3 in response to an external command. The exhaust heat recovery device 2 causes heat exchange between exhaust gas from the engine 1 and the coolant in the second coolant circuit, thus functioning as a heat exchanger for heating the coolant with the heat produced by the exhaust gas.

The first coolant circuit is branched into a main path extending through the water pump 3, the engine 1, and a radiator 4 and a bypass path bypassing the radiator 4. The radiator 4, which is arranged in the main path of the first coolant circuit, radiates heat from the coolant in the first coolant circuit into the atmospheric air. In the main path, the coolant is sent out from the water pump 3, flows through the engine 1, the radiator 4, and a thermostat 5, and returns to the water pump 3. The thermostat 5 is a temperature sensitive type valve and opens when the temperature of the coolant that has passed through a heater core 6, which will be described later, rises to a prescribed value (which is, for example, 105° C.) or higher, thus permitting the coolant to flow through the radiator 4. When the temperature of the coolant that has passed through the heater core 6 is less than the prescribed value, the thermostat 5 closes to prohibit circulation of the coolant via the radiator 4. In other words, the radiator 4 of the cooling apparatus for a vehicle is activated to radiate heat from the coolant flowing through the engine 1 when the temperature of the coolant flowing into the thermostat 5 is the prescribed value or higher. A reservoir tank 13 for retaining an excess of the coolant is provided in the vicinity of the radiator 4. The thermostat 5 has a heat generating body that generates heat when supplied with the power. The thermostat 5 may thus be opened through heat generation by the heat generating body, even when the temperature of the coolant that has passed through the heater core 6 is less than the prescribed value.

In the bypass path of the first coolant circuit, the coolant is sent out from the water pump 3, flows through the engine 1, a valve 7, the heater core 6, and the thermostat 5, and returns to the water pump 3. The valve 7 in the bypass path is an electromagnetic ON/OFF valve. The heater core 6 functions as a heater for heating the air sent into the passenger compartment through heat exchange between the air and the coolant. The heater core 6 is also a heat using device that uses the heat recovered from the exhaust gas by the exhaust heat recovery device 2. The thermostat 5 is formed in such a manner as to constantly permit circulation of the coolant through the bypass path. Such circulation of the coolant through the bypass path is blocked in response to closure of the valve 7. Accordingly, when the valve 7 and the thermostat 5 are both closed, the circulation of the coolant through the engine 1 is stopped.

The second coolant circuit is branched into two paths, which are a path extending through a throttle body 9 of the engine 1 and a path bypassing the throttle body 9, after the coolant exits the water pump 3. These paths then remerge with each other, extend through an EGR cooler 10 and the exhaust heat recovery device 2, and then merge with the bypass path at a position upstream from the heater core 6. The EGR cooler 10, which is provided in the second coolant circuit, cools the exhaust gas (recirculated exhaust gas) that is returned from the exhaust system to the intake system in the engine 1.

The flow rate (hereinafter, referred to as discharge flow rate) of the coolant discharged by the water pump 3 of the cooling apparatus for a vehicle and opening/closing of the valve 7 are controlled by an engine cooling control section 11. When controlling the opening/closing of the valve 7, the engine cooling control section 11 functions as a valve control section. The engine cooling control section 11 also controls forcible opening of the thermostat 5 through the heat generation by the heat generating body and prohibits operation of the engine 1 to prevent overheating of the engine 1.

The engine cooling control section 11 is configured as an electronic control unit including a CPU, a ROM, a RAM, and an I/O. The CPU performs various types of calculation procedures related to cooling control of the engine 1. The ROM stores control programs and data. The RAM temporarily stores in memory calculation results of the CPU and detection results of sensors. The I/O inputs and outputs signals from and to the exterior. The engine cooling control section 11 receives detection signals from a coolant temperature sensor 12 for detecting a coolant temperature thw1 in the engine 1, a coolant temperature sensor 14 for detecting the temperature of the coolant flowing into the heater core 6 (a coolant temperature thw2), and an airflow meter 16 for detecting the intake air amount of the engine 1.

The vehicle also includes an air conditioning control section 15, which controls air conditioning in the passenger compartment, or, specifically, heating of the air in the heater core 6 and supply of air into the passenger compartment. Like the engine cooling control section 11, the air conditioning control section 15 is configured by an electronic control unit having a CPU, a ROM, a RAM, and an I/O. The air conditioning control section 15 and the engine cooling control section 11 are connected to each other through an in-vehicle network (CAN) and communicate with each other to share necessary information.

When the engine 1 is cold, the engine cooling control section 11 closes the valve 7 to prohibit circulation of the coolant through the engine 1, which is, in other words, circulation of the coolant in the first coolant circuit. By prohibiting the coolant circulation in the first coolant circuit in this manner, the coolant is retained in the engine 1. This raises the temperature of the coolant in the engine 1, thus advancing the warm-up of the engine 1.

In this state, the coolant circulates only in the second coolant circuit. In other words, the coolant is sent from the water pump 3 and circulates by flowing through the throttle body 9, the EGR cooler 10, the exhaust heat recovery device 2, the heater core 6, and the thermostat 5. The coolant in the second coolant circuit is heated by the heat recovered from the exhaust gas by the EGR cooler 10 and the exhaust heat recovery device 2. If the heater in the passenger compartment is on in this state, the air sent into the passenger compartment is heated by the heat recovered from the exhaust gas by the EGR cooler 10 and the exhaust heat recovery device 2. In this case, much of the recovered heat is consumed by the heater, and rise of the temperature of the coolant is retarded. As a result, the temperature of the coolant in the engine 1 rises at an earlier stage than the coolant in the second coolant circuit. If the coolant in the second coolant circuit is mixed with the coolant in the first coolant circuit with the coolant temperature in the engine 1 exceeding the determination value (which is, for example, 90° C.) for the completion of the warm-up of the engine 1, the temperature of the coolant in the engine 1 fluctuates around the determination value for the warm-up completion of the engine 1. This may cause a problem in some controls for changing the content of control depending on whether or not the coolant temperature in the engine 1 is greater than or equal to the determination value for the warm-up completion of the engine 1.

To solve this problem, the cooling apparatus for a vehicle of the first embodiment closes the valve 7 when the coolant temperature in the engine 1 is less than a half-warm-up determination value (which is, for example, 70° C.) lower than the determination value for the warm-up completion of the engine 1. When the coolant temperature in the engine 1 is greater than or equal to the half-warm-up determination value, the valve 7 is opened to mix the coolants in the two coolant circuits together. Accordingly, even if the temperature of the coolant in the engine 1 is fluctuated by mixing the coolants at different temperatures together, such fluctuation occurs in a temperature range lower than the determination value for the warm-up completion of the engine 1. This prevents a control procedure for the time before the engine warm-up completion and a control procedure for the time after such completion from being carried out in a repeating, alternating manner.

FIG. 2 represents the coolant circulating state in the engine 1, the operating state of the valve 7, and the operating state of the thermostat 5 in the cooling apparatus for a vehicle of the first embodiment in correspondence with the warm-up state of the engine 1. As represented in the table, when the engine 1 is cold, the valve 7 and the thermostat 5 are closed and the coolant circulation in the engine 1 is stopped. When the engine 1 is in a half-warmed-up state, the valve 7 is opened to resume the coolant circulation in the engine 1. After the engine 1 is warmed up, the thermostat 5 is also opened to operate the radiator 4 to radiate heat from the coolant.

Figure 3:
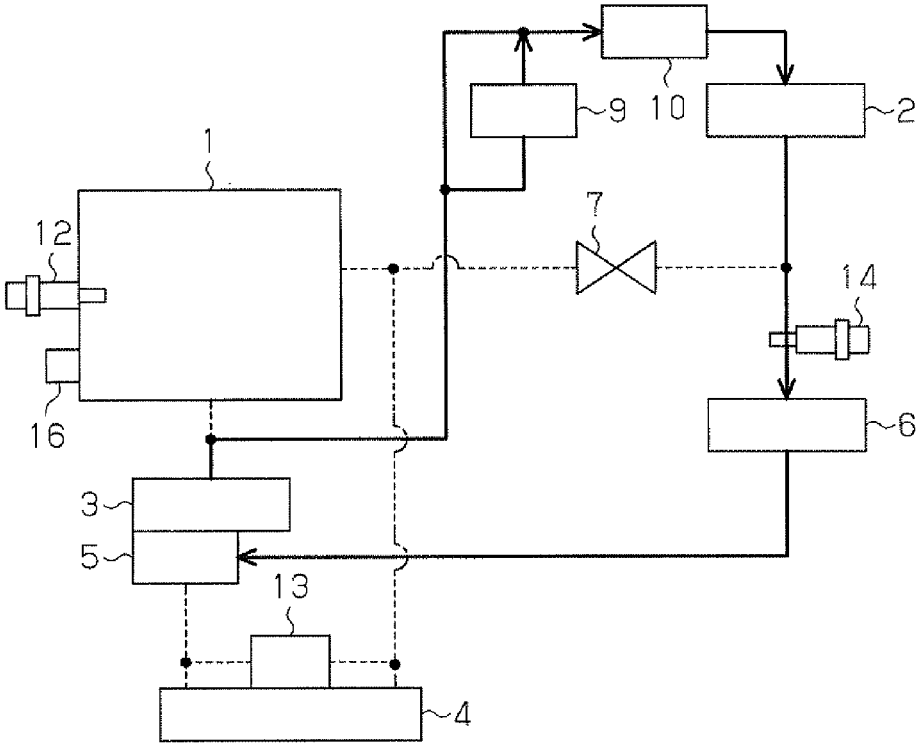
FIG. 3 is a block diagram representing a coolant flow in the cooling apparatus for a vehicle of the first embodiment at the time when the engine is cold.

FIG. 3 represents the coolant flow at the time when the engine 1 is cold. In this state, the valve 7 and the thermostat 5 are both closed. The coolant is thus circulated only in the second coolant circuit. Specifically, the coolant is discharged by the water pump 3 and circulates by flowing through the throttle body 9, the EGR cooler 10, the exhaust heat recovery device 2, the heater core 6, and the thermostat 5. The coolant circulation in the engine 1 is suspended in this state.

Figure 4:
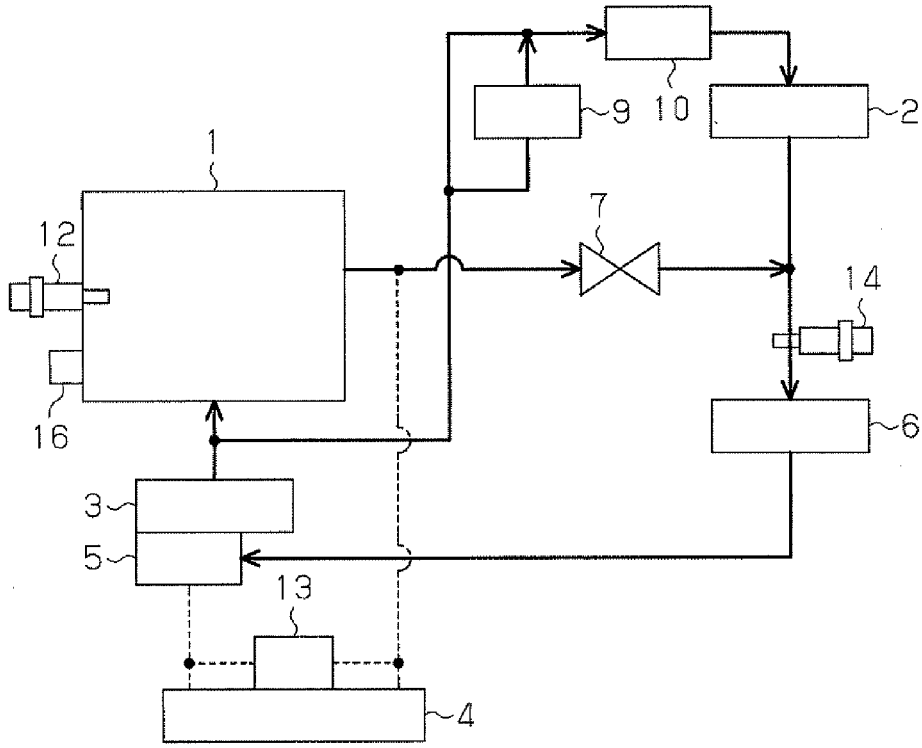
FIG. 4 is a block diagram illustrating a coolant flow in the cooling apparatus for a vehicle of the first embodiment at the time when the engine is in a half-warmed-up state.

FIG. 4 represents the coolant flow at the time when the engine 1 is in the half-warmed-up state. In this state, the valve 7 is open and the circulation of the coolant through the engine 1 is resumed. Accordingly, the coolant that has passed through the engine 1 flows through the valve 7 and is mixed with the coolant flowing in the second coolant circuit at a position upstream from the heater core 6.

Figure 5:
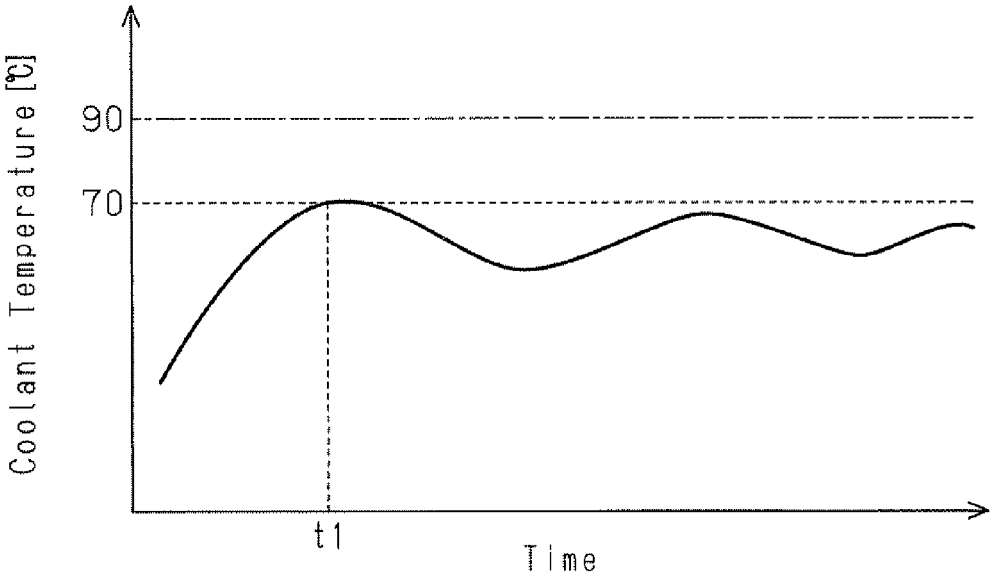
FIG. 5 is a graph representing change of the coolant temperature in the engine in the cooling apparatus for a vehicle of the first embodiment before and after the valve is opened.

FIG. 5 represents change of the coolant temperature in the engine 1 before and after the valve 7 opens. In the cooling apparatus for a vehicle of the first embodiment, when the coolant temperature in the engine 1 rises to the half-warm-up determination value (for example, 70° C.), which is lower than the warm-up determination value (for example, 90° C.), or higher, the coolant in the first coolant circuit and the coolant in the second coolant circuit are mixed together. As a result, even if the coolant temperature in the second coolant circuit is low at this stage and the coolant temperature in the engine 1 fluctuates due to mixing of the coolant, such fluctuation is restricted in the temperature range sufficiently lower than the determination value for the warm-up completion of the engine 1, as represented in FIG. 5.

If the valve 7 is stuck closed, or a closed valve failure occurs, the coolant circulation in the first coolant circuit is prohibited regardless of the temperature of the coolant in the first coolant circuit and the flow rate of the coolant is maintained as zero. This hampers effective cooling of the engine 1 by the coolant and thus may cause overheating of the engine 1. If the valve 7 is stuck open, or an open valve failure occurs, the valve 7 is maintained open even when the engine 1 is cold. This permits the coolant in the first coolant circuit to flow through the engine 1 by a large amount, thus retarding the warm-up of the engine 1. The fuel efficiency may thus increase disadvantageously. To prevent the overheating of the engine 1 caused by the aforementioned closed valve failure of the valve 7 and the retarded warm-up and a decrease in fuel efficiency of the engine 1 caused by the open valve failure of the valve 7, these failures of the valve 7 must be detected at an early stage.

A procedure for detecting a closed valve failure and the open valve failure in the valve 7 at an early stage after such failures occur will hereafter be described with reference to FIGS. 6 and 7.

Figure 6:
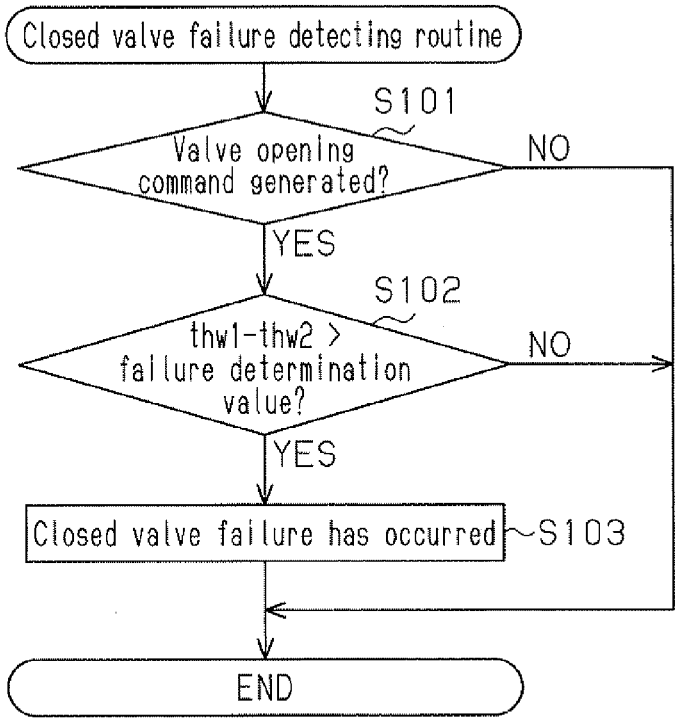
FIG. 6 is a flowchart representing a procedure for detecting a closed valve failure in the valve.

FIG. 6 is a flowchart representing a closed valve failure detecting routine for detecting a closed valve failure in the valve 7. The closed valve failure detecting routine is performed by the engine cooling control section 11 periodically by time interruption at predetermined time intervals.

In the closed valve failure detecting routine, it is determined whether the coolant temperature thw1 is greater than or equal to the half-warm-up determination value and a valve opening command is generated (S101). If a positive determination is made in step S101, it is determined whether the difference between the coolant temperature thw1 and the coolant temperature thw2, which is, more specifically, the value "thw1−thw2" obtained by subtracting the coolant temperature thw2 from the coolant temperature thw1, is greater than a failure determination value (S102). Specifically, if a closed valve failure has occurred in the valve 7, a coolant flow in the engine 1, which should occur through opening of the valve 7 when the valve 7 normally functions, is prevented. This raises the temperature of the coolant (the coolant temperature thw1) in the engine 1, thus increasing the value "thw1−thw2". When the value "thw1−thw2" is greater than the failure determination value, it is determined that a closed valve failure has occurred in the valve 7 (S103). The engine cooling control section 11 functions as a determining section for determining occurrence of a closed valve failure in the valve 7.

For the failure determination value, a value obtained in advance through a test or the like may be used as an optimal value for determining whether a closed valve failure has occurred in the valve 7. For example, tests for determining the value "thw1−thw2" may be repeated for a plurality of times to obtain an average of the data (the values "thw1−thw2") from the respective tests. The average is then modified by taking into consideration a determination error, and the obtained value is defined as the failure determination value.

As has been described, in the cooling apparatus for a vehicle of the first embodiment, when the coolant temperature thw1 is greater than or equal to the half-warm-up determination value and a command for opening the valve 7 is generated, it is determined that a closed valve failure has occurred in the valve 7 if the difference between the coolant temperature thw1 and the coolant temperature thw2 ("thw1−thw2") is greater than the failure determination value. As a result, if a closed valve failure has occurred in the valve 7, the failure is detected at an early stage, thus preventing the overheating of the engine 1 caused by a closed valve failure of the valve 7.

Figure 7:
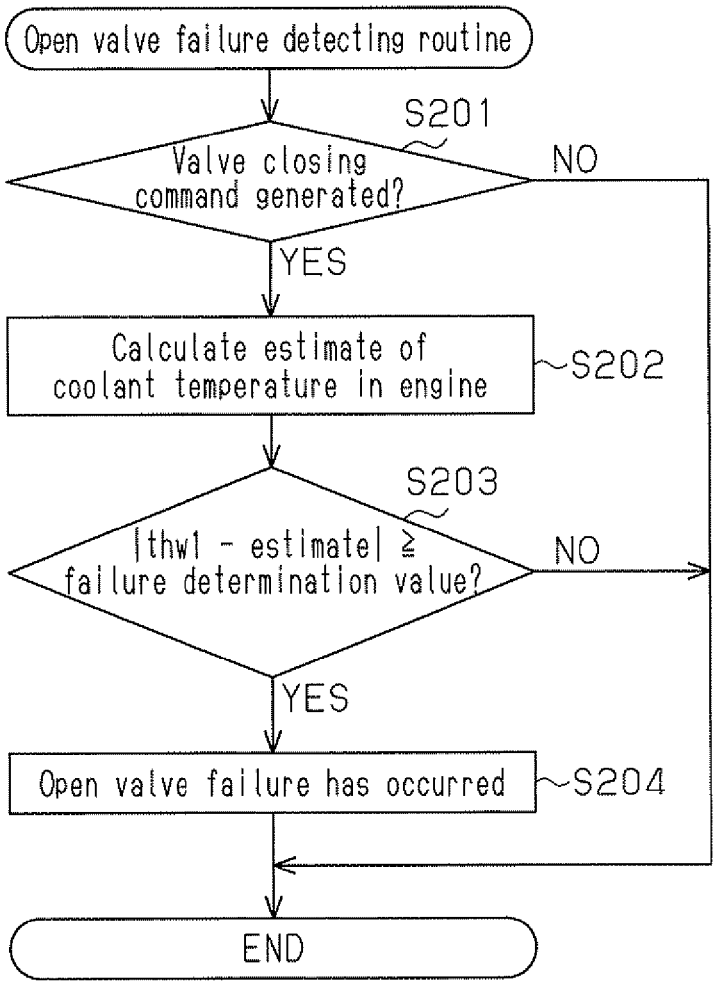
FIG. 7 is a flowchart representing a procedure for detecting an open valve failure in the valve.

FIG. 7 is a flowchart representing an open valve failure detecting routine for detecting the open valve failure in the valve 7. The open valve failure detecting routine is performed by the engine cooling control section 11 periodically by time interruption at predetermined time intervals.

In the open valve failure detecting routine, it is determined whether the coolant temperature thw1, which is the actual measurement value of the temperature of the coolant in the engine 1, is less than the half-warm-up determination value and a closing command for the valve 7 is generated (S201). If the determination in step S201 is positive, an estimate of the coolant temperature in the engine 1 is determined (S202). Specifically, a rising amount of the coolant temperature thw1 since the time point at which start-up of the engine 1 is initiated is estimated and added to an initial value of the coolant temperature thw1 memorized at the time point of initiation of the start-up of the engine 1. In this manner, the estimate of the coolant temperature in the engine 1 is obtained. The rising amount of the coolant temperature thw1 since the time point of the start-up initiation of the engine 1 is estimated based on a value (an integrated value) obtained by accumulating values of the intake air amount of the engine 1, which are determined based on detection signals from the airflow meter 16, at predetermined timings.

It is then determined whether the absolute value of the difference between the coolant temperature thw1 and the estimate of the coolant temperature thw1 is greater than or equal to a failure determination value (S203). Specifically, if the open valve failure has occurred in the valve 7, a coolant flow in the engine 1, which has to be prevented by closure of the valve 7 when the valve 7 normally functions, occurs. This prevents rise of the actual measurement value of the temperature of the coolant in the engine 1 (the coolant temperature thw1). On the other hand, the estimate of the coolant temperature in the engine 1 gradually increases as the engine 1 continuously operates. As a result, the actual measurement value of the coolant temperature in the engine 1 (the coolant temperature thw1) becomes excessively low with respect to the estimate of the coolant temperature thw1. This increases the absolute value of the difference between the coolant temperature thw1 and the estimate of the coolant temperature thw1. When the set value rises to the failure determination value or higher, it is determined that the open valve failure has occurred in the valve 7 (S204). For the failure determination value, a value determined in advance through a test or the like may be employed as an optimal value for determining whether the open valve failure has occurred in the valve 7. The engine cooling control section 11 functions as a determining section for determining whether the open valve failure has occurred in the valve 7.

As has been described, in the cooling apparatus for a vehicle of the first embodiment, when the coolant temperature thw1 is less than the half-warm-up determination value and a command for closing the valve 7 is generated, it is determined that the open valve failure has occurred in the valve 7 on condition that the absolute value of the difference between the coolant temperature thw1 and the estimate of the coolant temperature thw1 is greater than or equal to the failure determination value. As a result, if the open valve failure has been brought about in the valve 7, the failure is detected at an early stage, thus preventing the retarded warm-up and a decrease in fuel efficiency of the engine 1 caused by the open valve failure of the valve 7.

Figure 8:
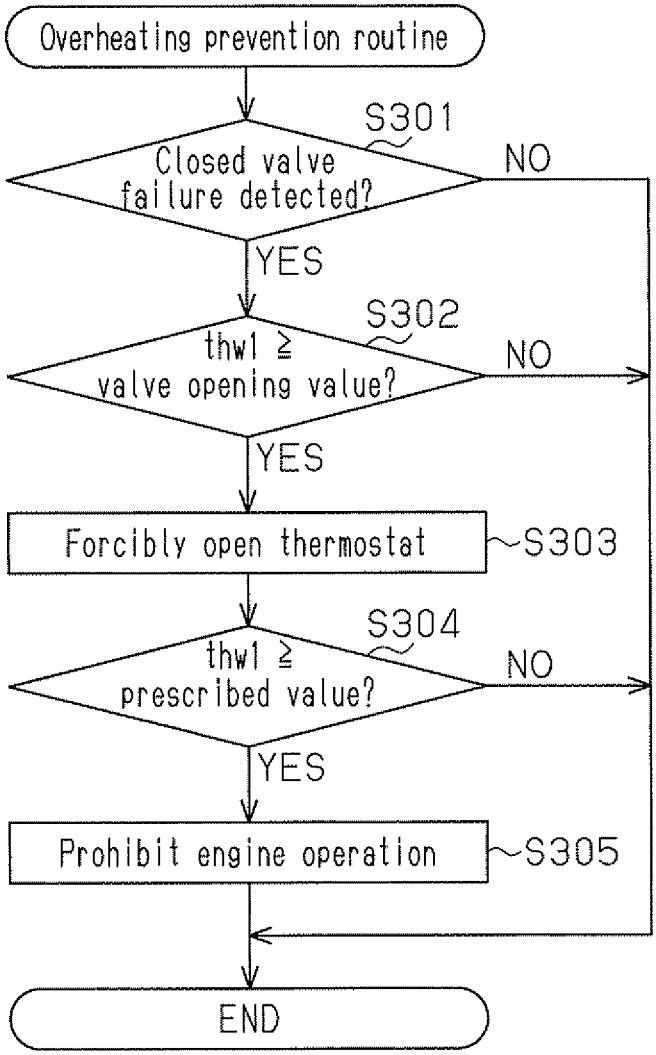
FIG. 8 is a flowchart representing a procedure for preventing engine overheating caused by a closed valve failure of the valve.

A routine for preventing the overheating of the engine 1 caused by a closed valve failure of the valve 7 will hereafter be described with reference to the flowchart of FIG. 8, which represents an overheating prevention routine. The overheating prevention routine is executed by the engine cooling control section 11 periodically by time interruption at predetermined time intervals.

In the overheating prevention routine, it is first determined whether a closed valve failure has occurred in the valve 7 (S301). If a closed valve failure has happened in the valve 7, it is determined whether the coolant temperature thw1 is greater than or equal to a valve opening value (for example, 100° C.), which is lower than the aforementioned prescribed value (S302). If the coolant temperature thw1 is greater than or equal to the valve opening value, the thermostat 5 is forcibly opened through the heat generation by the heat generating body of the thermostat 5 (S303). The engine cooling control section 11 functions as a thermostat control section for forcibly opening the thermostat 5 by causing the heat generating body of the thermostat 5 to generate heat.

In this manner, when the coolant temperature thw1 is less than the aforementioned prescribed value and not less than the valve opening value, the thermostat 5 is forcibly opened to permit coolant circulation through the radiator 4 in the main path of the first coolant circuit. This sends the coolant through the engine 1, and the radiator 4 radiates heat from the coolant that has passed through the engine 1. As a result, even if a closed valve failure has occurred in the valve 7, the engine 1 is prevented from overheating due to the closed valve failure.

If the coolant temperature thw1 rises continuously after the thermostat 5 is forcibly opened and thus increases to the aforementioned prescribed value or higher (YES in S304), operation of the engine 1 is prohibited (S305). This stops heat generation by the engine 1, thus preventing the overheating of the engine 1 through the heat generation by the engine 1 caused by a closed valve failure in the valve 7. The engine cooling control section 11 functions as a prohibiting section for prohibiting the operation of the engine 1.

The first embodiment, which has been described in detail, has the advantages described below.

(1) When the temperature of the coolant in the engine 1 (the coolant temperature thw1) rises to a value higher than or equal to the half-warm-up determination value (for example, 70° C.), which is lower than the determination value for the warm-up completion of the engine 1, the valve 7 is opened to mix the coolant in the two coolant circuits together. Accordingly, even if the coolant temperature in the engine 1 is fluctuated by mixing the coolants with different temperatures, such fluctuation occurs in the temperature range lower than the determination value for the warm-up completion of the engine 1. This prevents a control procedure for the time before the warm-up completion and a control procedure for the time after such completion from being carried out in a repeating, alternating manner. As a result, when the coolant circulating in the first coolant circuit is mixed with the coolant circulating in the second coolant circuit, control procedures using the coolant temperature in the engine 1 are carried out without hindrance.

(2) When the coolant temperature thw1 is greater than or equal to the half-warm-up determination value and a command for opening the valve 7 is generated, it is determined that a closed valve failure has occurred in the valve 7 if the difference between the coolant temperature thw1 and the coolant temperature thw2 ("thw1−thw2") is greater than or equal to the failure determination value. This ensures early detection of a closed valve failure in the valve 7 and thus prevents the overheating of the engine 1 caused by the closed valve failure. Also, it is unnecessary to arrange an additional sensor or the like for detecting the open/closed state of the valve 7 to detect a closed valve failure in the valve 7. This decreases the cost for detecting a closed valve failure of the valve 7.

(3) If the coolant temperature thw1 is less than the half-warm-up determination value and the closing command for the valve 7 is generated, it is determined that the open valve failure has occurred in the valve 7 on condition that the absolute value of the difference between the actual measurement value of the temperature of the coolant passing through the engine 1 (the coolant temperature thw1) and the estimate of the coolant temperature thw1 is greater than or equal to the failure determination value. Accordingly, if the closed valve failure has occurred in the valve 7, the open valve failure is detected early to prevent the retarded warm-up and a decrease in fuel efficiency of the engine 1 from being caused by the open valve failure. Also, it is unnecessary to arrange an additional sensor or the like for detecting the open/closed state of the valve 7 to detect the open valve failure of the valve 7. This reduces the cost for detecting the open valve failure in the valve 7.

(4) If a closed valve failure has occurred in the valve 7 and the coolant temperature thw1 is higher than or equal to the valve opening value (for example, 100° C.), which is less than the aforementioned prescribed value, the thermostat 5 is forcibly opened through the heat generation by the heat generating body of the thermostat 5. This permits the coolant circulation through the radiator 4 in the main path of the first coolant circuit. The coolant thus flows through the engine 1 and the radiator 4 radiates heat from the coolant that has passed through the engine 1. Accordingly, if a closed valve failure has occurred in the valve 7, overheating of the engine 1 is prevented from being caused by a closed valve failure of the valve 7. Further, forcible opening of the thermostat 5 is performed appropriately under a condition that necessitates prevention of the overheating of the engine 1, or, in other words, on condition that the coolant temperature thw1 is greater than or equal to the valve opening value. As a result, the overheating of the engine 1 is prevented if a closed valve failure has occurred in the valve 7 without unnecessarily opening the thermostat 5 in the forcible manner.

(5) If a closed valve failure has occurred in the valve 7 and the coolant temperature thw1 rises to a value higher than or equal to the prescribed value, operation of the engine 1 is prohibited to suspend the heat generation by the engine 1. This prevents overheating of the engine 1 from being caused by the heat generation by the engine 1 due to the closed valve failure of the valve 7. The operation of the engine 1 is prohibited appropriately under a condition that necessitates prevention of the overheating of the engine 1, or, in other words, on condition that the coolant temperature thw1 is greater than or equal to the prescribed value. As a result, the overheating of the engine 1 is prevented from being caused by the closed valve failure of the valve 7 without unnecessarily prohibiting the operation of the engine 1.

Second Embodiment

A second embodiment of the present invention will hereafter be described with reference to FIGS. 9 to 16.

In the second embodiment, when the valve 7 has a closed valve failure, the coolant is circulated in a bypass path of the first coolant circuit, instead of circulating the coolant in the main path of the first coolant circuit by forcibly opening the thermostat 5 as in the first embodiment.

Figure 9:
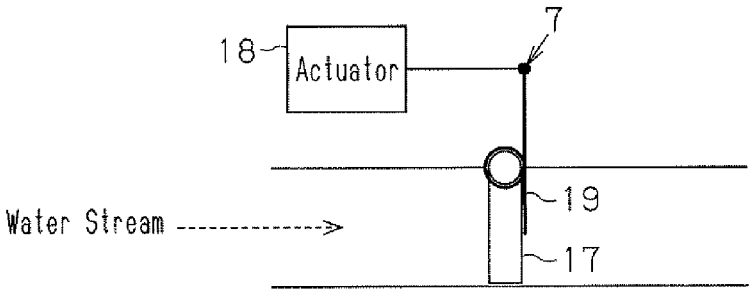
FIG. 9 is a diagram schematically illustrating the configuration of a valve of a second embodiment of the cooling apparatus for a vehicle according to the present invention.

Specifically, in the cooling apparatus for a vehicle according to the second embodiment, even when the valve 7 has a closed valve failure, the coolant is circulated in the bypass path of the first coolant circuit by increasing the discharge flow rate of the water pump 3 compared with a normal usage range. Specifically, the valve 7 may be configured as illustrated in FIG. 9. When the discharge flow rate of the water pump 3 exceeds the normal usage range, the valve 7 illustrated in the drawing is allowed to send the coolant by a flow rate necessary for cooling the engine 1 even when the valve 7 is closed.

Figure 10:
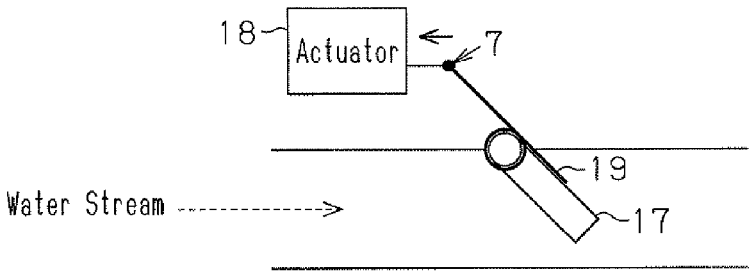
FIG. 10 is a diagram schematically illustrating an open state of the valve.
Figure 11:
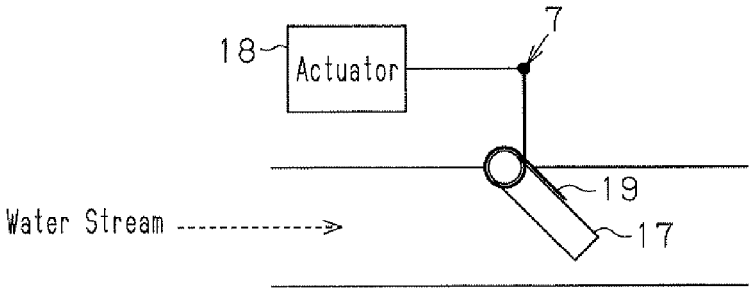
FIG. 11 is a diagram schematically illustrating an open state of the valve.

A valve body 17 of the valve 7 is selectively opened and closed by an actuator 18 as illustrated in FIGS. 9 and 10. The valve body 17 is urged by a spring 19 in a valve closing direction when located at an open/close position set by the actuator 18. The valve body 17 is movable in a valve opening direction against urging force applied by the spring 19 with respect to the open/close position. The urging force of the spring 19 is set to such a value that permits the valve body 17 to move in the valve opening direction as illustrated in FIG. 11 to provide the coolant flow rate necessary for cooling the engine 1 at the time when the discharge flow rate of the water pump 3 is increased to a value greater than the normal usage range with the valve body 17 of the valve 7 held at a closed position by the actuator 18.

Figure 12:
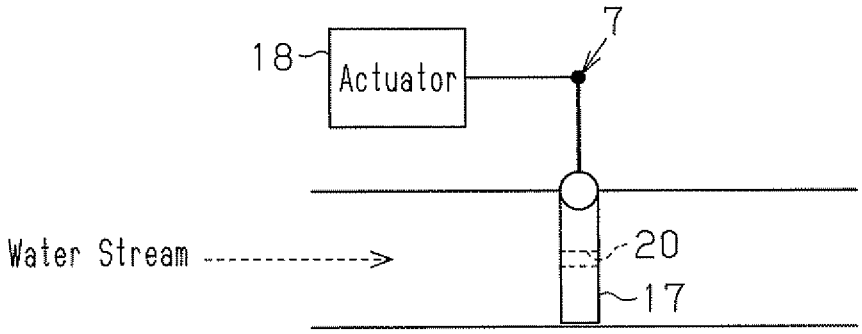
FIG. 12 is a diagram schematically illustrating another example of the valve of the second embodiment.
Figure 13:
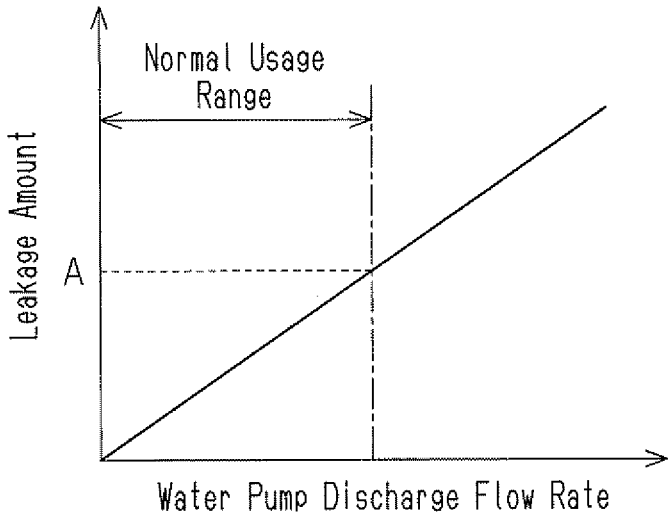
FIG. 13 is a graph representing the relationship between the leakage amount of the coolant from the valve and the discharge flow rate of a water pump.

Alternatively, the valve 7 illustrated in FIG. 9 may be replaced by the valve 7 illustrated in FIG. 12. A hole 20 through which the coolant flows is formed in the valve body 17 of the valve 7. When the valve body 17 of the valve 7 is held at the closed position by the actuator 18, the flow rate (the leakage amount) of the coolant flowing through the hole 20 of the valve body 17 gradually increases as represented in FIG. 13 as the discharge flow rate of the water pump 3 gradually increases. When the discharge flow rate of the water pump 3 is in the normal usage range, the leakage amount is such a value that prevents adverse influence on promotion of warm-up of the engine 1. When the discharge flow rate of the water pump 3 exceeds the normal usage range, the leakage amount becomes such a value that is necessary for cooling the engine 1 (a value greater than or equal to "A" in FIG. 13). Specifically, the inner diameter of the hole 20 in the valve body 17 is set to such a value that the flow rate of the coolant flowing through the hole 20 becomes the aforementioned values in correspondence with the discharge flow rate of the water pump 3.

Figure 14:
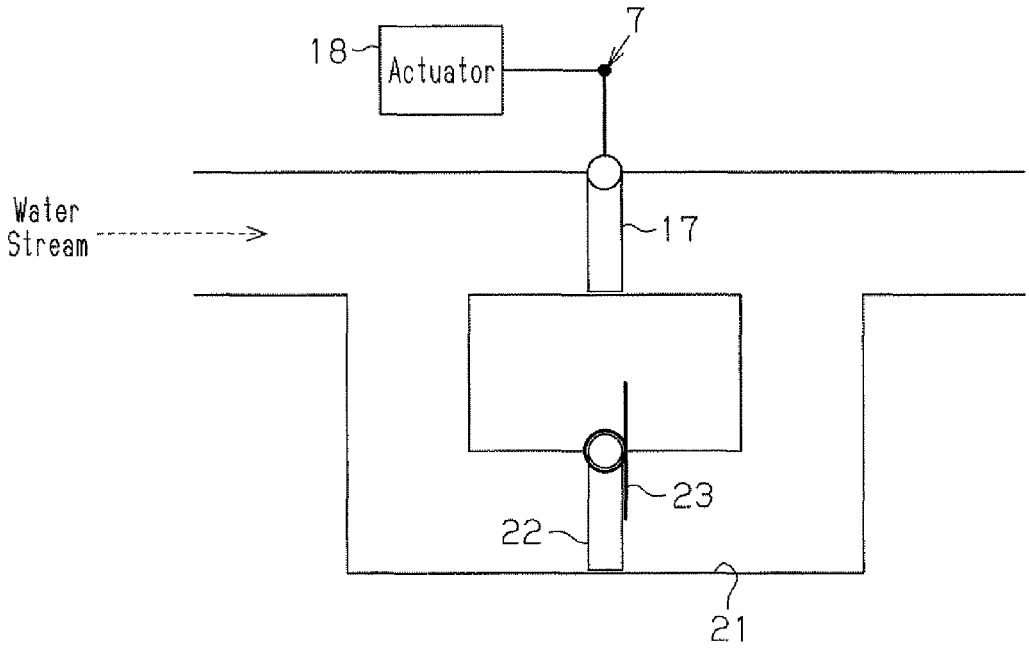
FIG. 14 is a diagram schematically illustrating an example of the peripheral structure of the valve of the second embodiment.
Figure 15:
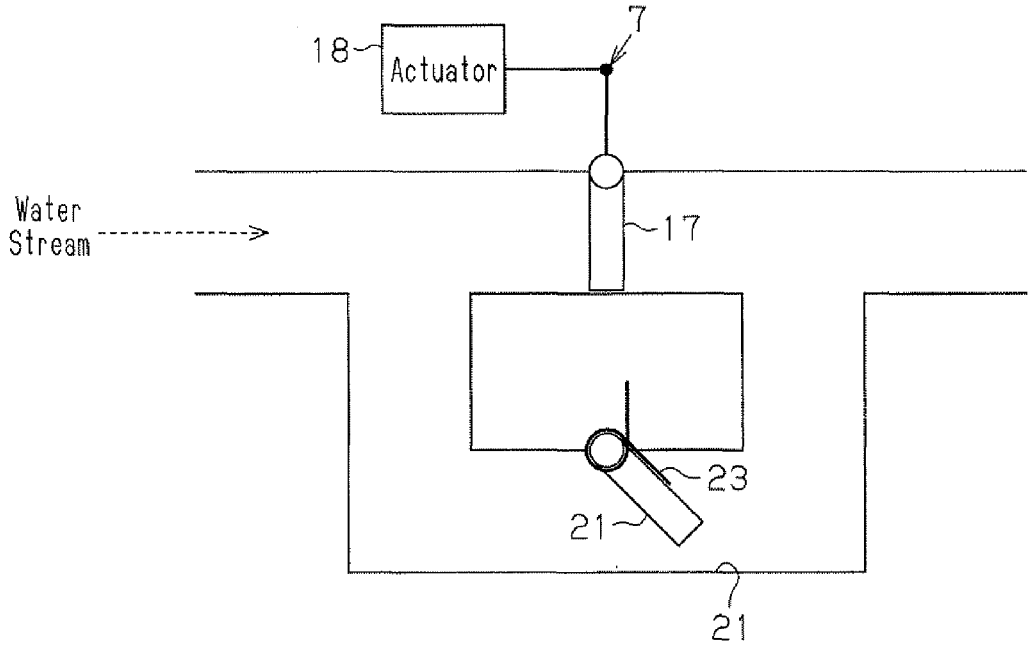
FIG. 15 is a diagram schematically illustrating another example of the peripheral structure of the valve of the second embodiment.

Alternatively, the valve 7 and the peripheral components may be configured as illustrated in FIG. 14 in order to ensure the coolant circulation in the bypass path of the first coolant circuit by increasing the discharge flow rate of the water pump 3 at the time of the closed valve failure of the valve 7. In this configuration, a detour passage 21 that detours the valve body 17 of the valve 7 is provided in the bypass path of the first coolant circuit. A west gate valve 22 is arranged in the detour passage 21. The west gate valve 22 is urged to close by a spring 23 when the discharge flow rate of the water pump 3 is in the normal usage range. When the discharge flow rate of the water pump 3 exceeds the normal usage range, a water stream in the detour passage 21 causes the west gate valve 22 to open against the urging force of the spring 23, as illustrated in FIG. 15. Specifically, the urging force of the spring 23 applied to the west gate valve 22 is set to such a value that permits the west gate valve 22 to selectively open and close in correspondence with the discharge flow rate of the water pump 3. The inner diameter of the detour passage 21 and the open degree of the valve 22 when held in an open state are set to such values that permit the coolant of the flow rate necessary for cooling the engine 1 to flow in the detour passage 21 when the west gate valve 22 is open.

Figure 16:
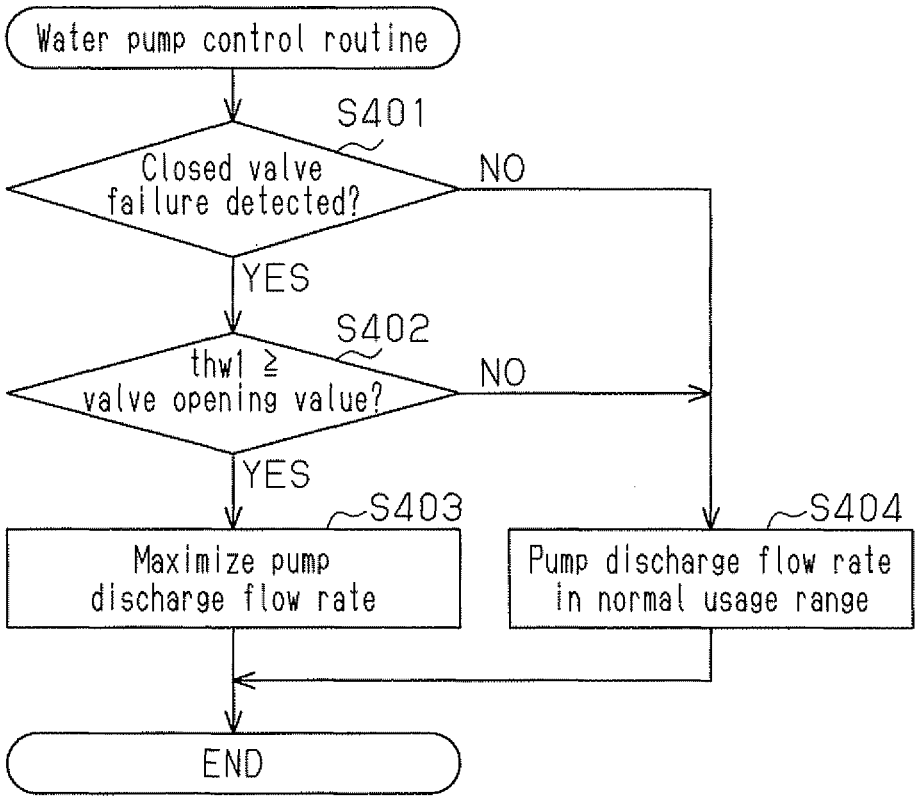
FIG. 16 is a flowchart representing a control procedure for the water pump of the second embodiment.

FIG. 16 is a flowchart representing a water pump control routine for controlling the discharge flow rate of the water pump 3. The water pump control routine is performed by the engine cooling control section 11 functioning as a pump control section periodically by time interruption at predetermined time intervals.

In the water pump control routine, it is first determined whether a closed valve failure has occurred in the valve 7 (S401). When the valve 7 has a closed valve failure, it is determined whether the coolant temperature thw1 is higher than or equal to the aforementioned valve opening value (for example, 100° C.) (S402). If the coolant temperature thw1 is less than the valve opening value, the water pump 3 is normally operated to maintain the discharge flow rate of the water pump 3 in the normal usage range (S404). In contrast, if the coolant temperature thw1 is greater than or equal to the valve opening value, the discharge flow rate of the water pump 3 is increased to a value greater than the normal usage range, which is, for example, the maximum discharge flow rate (S403). This permits the coolant circulation in the bypass path of the first coolant circuit when the coolant temperature thw1 is the valve opening value or higher. As a result, even if a closed valve failure has occurred in the valve 7, the coolant is sent to the engine 1, thus preventing the engine 1 from overheating due to the closed valve failure.

The second embodiment, which has been described in detail, has the advantage described below in addition to the advantages (1) to (3) and (5) of the first embodiment.

(6) When the valve 7 has a closed valve failure, the discharge flow rate of the water pump 3 is increased to a value greater than the normal usage range on condition that the coolant temperature thw1 is greater than or equal to the valve opening value. In this manner, by employing the valve 7 illustrated in FIG. 9 or the valve 7 illustrated in FIG. 12, the coolant of the flow rate necessary for cooling the engine 1 is allowed to flow through the valve 7 and pass through the engine 1 even if a closed valve failure has occurred in the valve 7. As a result, even when the valve 7 has a closed valve failure, the engine 1 is prevented from overheating due to the closed valve failure. If the peripheral components of the valve 7 are configured as illustrated in FIG. 14, the west gate valve 22 in the detour passage 21 is opened by increasing the discharge flow rate of the water pump 3 to a value greater than the normal usage range. This permits the coolant of the flow rate necessary for cooling the engine 1 to flow via the detour passage 21 and pass through the engine 1 even if a closed valve failure has occurred in the valve 7. As a result, even when the valve 7 has a closed valve failure, the engine 1 is prevented from overheating due to the closed valve failure.

Third Embodiment

A third embodiment of the present invention will hereafter be described with reference to FIG. 17.

The third embodiment solves a problem caused by a failure such as a breakage happening in one of the coolant temperature sensors 12, 14 of the first embodiment.

If one of the coolant temperature sensors 12, 14 has a failure, the coolant temperature detected by the malfunctioning one of the coolant temperature sensors 12, 14 does not reflect the actual coolant temperature. This hampers proper execution of various controls performed based on the coolant temperature detected by the malfunctioning coolant temperature sensor 12, 14. For example, when the coolant temperature sensor 12 has a failure, controls performed based on the coolant temperature thw1 cannot be carried out appropriately. When the coolant temperature sensor 14 has a failure, control for heating the air in the heater core 6 and control for sending the heated air into the passenger compartment, which are performed based on the coolant temperature thw2, cannot be carried out appropriately.

To solve the problem, in the cooling apparatus for a vehicle according to the third embodiment, if a failure has occurred in one of the coolant temperature sensors 12, 14, the first coolant circuit and a second coolant circuit are connected to each other. In this manner, the coolant temperature detected by the malfunctioning one of the coolant temperature sensors approximates the coolant temperature detected by the normally functioning one of the coolant temperature sensors. This enables replacement of the coolant temperature detected by the malfunctioning coolant temperature sensor with the coolant temperature detected by the normally functioning coolant temperature sensor. The replacement coolant temperature may be used to execute the aforementioned various controls.

Figure 17:
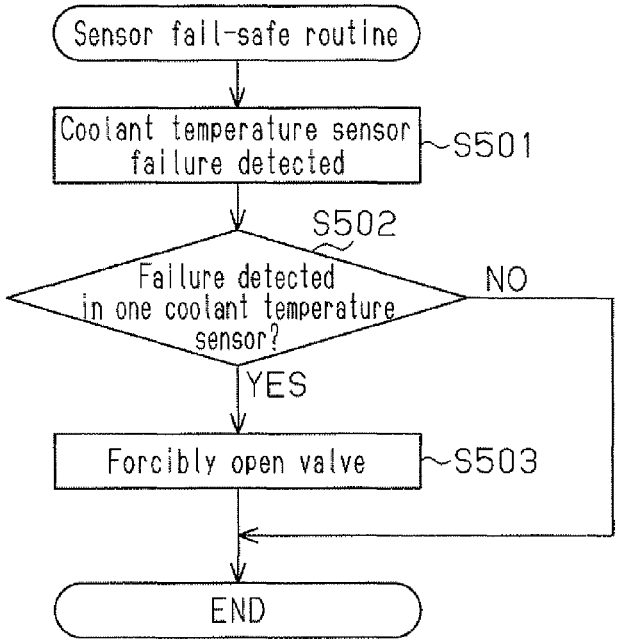
FIG. 17 is a flowchart representing a valve operating procedure at the time when a coolant temperature sensor malfunctions in a third embodiment of the cooling apparatus for a vehicle according to the present invention.

FIG. 17 is a flowchart representing a sensor fail-safe routine for connecting the first coolant circuit and the second coolant circuit to each other when one of the coolant temperature sensors 12, 14 has a failure, so that the coolant temperature detected by the malfunctioning one of the coolant temperature sensors 12, 14 can be replaced by the coolant temperature detected by the normally functioning one of the coolant temperature sensors 12, 14. The sensor fail-safe routine is carried out by the engine cooling control section 11 periodically by time interruption at predetermined time intervals.

In the sensor fail-safe routine, it is first detected whether a failure has occurred in the coolant temperature sensors 12, 14 (S501). Specifically, it is determined whether a detection signal has been input from the respective one of the coolant temperature sensors 12, 14. If a detection signal has not been input from either one of the coolant temperature sensors, the corresponding one of the coolant temperature sensors is determined as a malfunctioning sensor. Then, it is determined whether only one of the coolant temperature sensors 12, 14 has a failure (S502). If the determination in step S502 is positive, the valve 7 is forcibly opened (S503). This connects the first coolant circuit and the second coolant circuit to each other, thus mixing the coolants in the circuits. The coolant temperature detected by the malfunctioning coolant temperature sensor thus approximates to the coolant temperature detected by the normally functioning coolant temperature sensor. As a result, the coolant temperature detected by the malfunctioning coolant temperature sensor may be replaced by the coolant temperature detected by the normally functioning coolant temperature sensor.

The third embodiment has the advantage described below in addition to the advantages (1) to (5) of the first embodiment.

(7) Even if one of the coolant temperature sensors 12, 14 has a failure, the coolant temperature detected by the malfunctioning one of the coolant temperature sensors 12, 14 is replaced by the coolant temperature detected by the normally functioning one of the coolant temperature sensors 12, 14. The various controls are carried out based on the replacement coolant temperature.

Other Embodiments

The illustrated embodiments may be modified to the forms described below.

In the third embodiment, one of the coolant temperature sensors 12, 14 may be omitted. In this case, the coolant temperature to be detected by the omitted one of the coolant temperature sensors 12, 14 may be obtained through estimation. The temperature of the coolant in the engine 1 may be estimated based on the engine operating state. The temperature of the coolant at the position upstream from the heater core 6 may be estimated using the exhaust temperature of the engine 1 and the requested temperature of the air sent into the passenger compartment. Estimation of the coolant temperatures is carried out by the engine cooling control section 11. When estimating the coolant temperatures, the engine cooling control section 11 functions as a coolant temperature estimating section.

Figure 18:
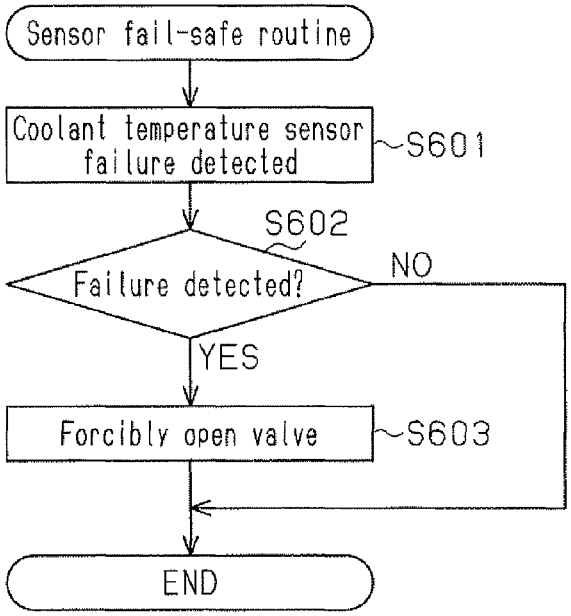
FIG. 18 is a flowchart representing a valve operating procedure at the time when the coolant temperature sensor malfunctions in another example of the third embodiment of the cooling apparatus for a vehicle according to the present invention.
Figure 19:
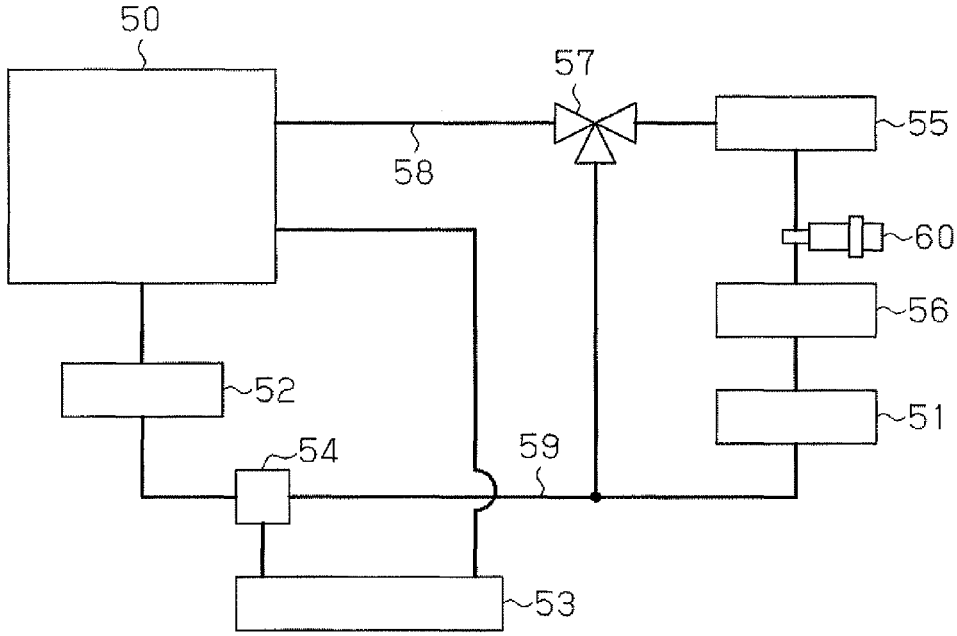
FIG. 19 is a block diagram schematically illustrating the configuration of a coolant circuit in a conventional cooling apparatus for a vehicle.
Figure 20:
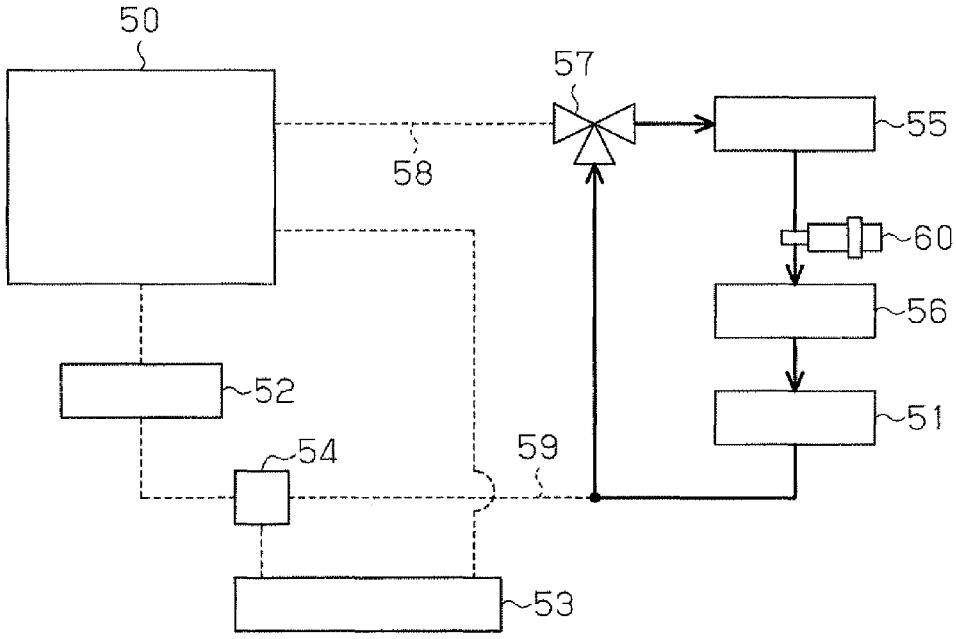
FIG. 20 is a block diagram representing a coolant flow in the conventional cooling apparatus for a vehicle at the time when the coolant temperature is low.
Figure 21:
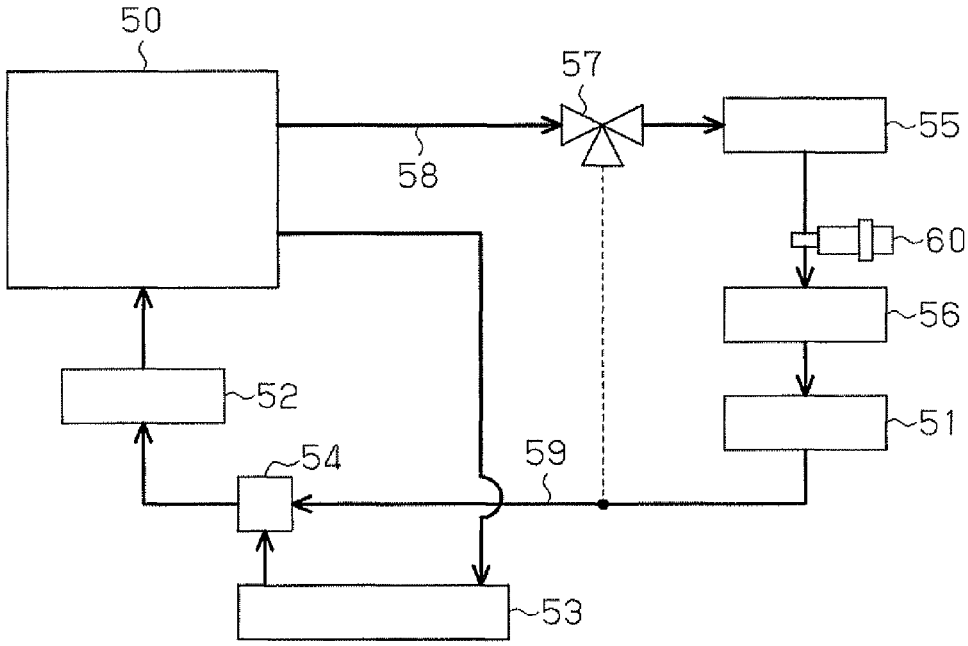
FIG. 21 is a block diagram representing a coolant flow in the conventional cooling apparatus for a vehicle at the time when the coolant temperature is high.
Figure 22:
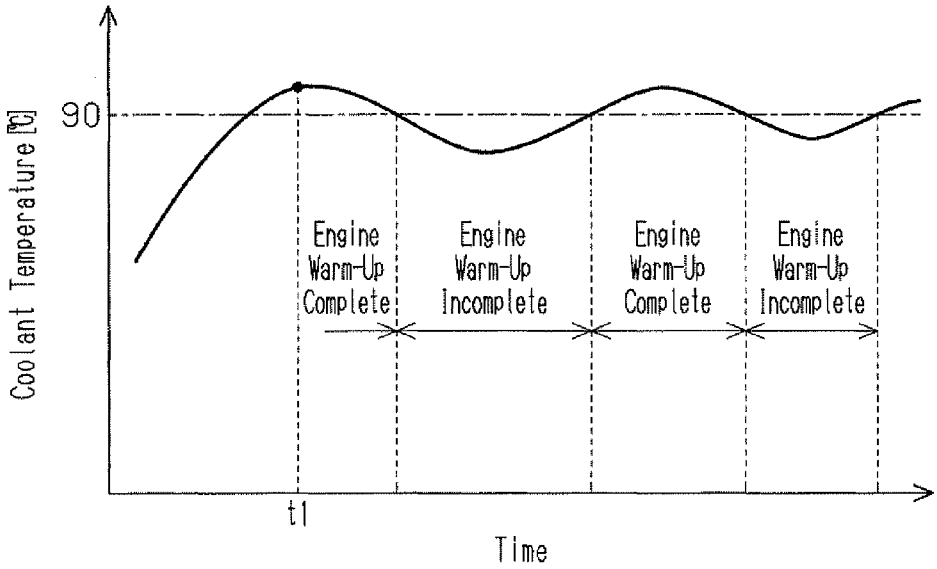
FIG. 22 is a graph representing change of the coolant temperature in the conventional cooling apparatus for a vehicle before and after the coolant is mixed.

FIG. 18 is a flowchart representing a sensor fail-safe routine corresponding to the above-described case. In the sensor fail-safe routine, it is first detected whether a failure has occurred in a coolant temperature sensor (S601). If it is determined that the coolant temperature sensor has a failure (YES in S602), the valve 7 is forcibly opened (S603). This connects the first coolant circuit and the second coolant circuit to each other, thus mixing the coolants in the coolant circuits. The coolant temperature detected by the malfunctioning coolant temperature sensor thus approximates to the coolant temperature obtained through the estimation. As a result, the coolant temperature detected by the malfunctioning coolant temperature sensor may be replaced by the coolant temperature obtained through the estimation.

Accordingly, when a coolant temperature sensor has a failure, the coolant temperature detected by the coolant temperature sensor may be replaced by the coolant temperature obtained through the estimation. The various controls are thus carried out based on the replacement coolant temperature.

In the second embodiment, the discharge flow rate of the water pump 3 is increased to a value greater than the normal usage range on condition that the coolant temperature thw1 is higher than or equal to the valve opening value. However, such a condition may be omitted and the discharge flow rate of the water pump 3 may be increased to a value greater than the normal usage range immediately after a closed valve failure occurs in the valve 7.

In the second embodiment, when the discharge flow rate of the water pump 3 is increased to a value greater than the normal usage range, the discharge flow rate does not necessarily have to be set to the maximum discharge flow rate.

In the first embodiment, the thermostat 5 is forcibly opened on condition that the coolant temperature thw1 is the valve opening value or greater. However, the condition may be omitted and the thermostat 5 may be forcibly opened immediately after a closed valve failure occurs in the valve 7.

In the first embodiment, operation of the engine 1 is prohibited on condition that the coolant temperature thw1 is greater than or equal to the prescribed value. However, the condition may be omitted and the operation of the engine 1 may be prohibited immediately after a closed valve failure occurs in the valve 7.

In the first embodiment, if the employed vehicle is the hybrid vehicle driven by the engine 1 and another drive source (such as a motor), the vehicle may be driven in an evacuating traveling mode by the drive source other than the engine 1 when the operation of the engine 1 is prohibited.

In the first to third embodiments, the flow rate of the coolant circulating in the bypass path of the first coolant circuit at the time when the valve 7 is closed may be "0" or simply decreased to a value approximate to "0".

In the first embodiment, forcible opening of the thermostat 5 and prohibition of the operation of the engine 1 may be carried out solely based on the coolant temperature thw1 regardless of whether a closed valve failure has occurred in the valve 7.

Description of the Reference Numerals

1 . . . engine, 2 . . . exhaust heat recovery device, 3 . . . water pump, 4 . . . radiator, 5 . . . thermostat, 6 . . . heater core, 7 . . . valve, 9 . . . throttle body, 10 . . . EGR cooler, 11 . . . engine cooling control section, 12 . . . coolant temperature sensor, 13 . . . reservoir tank, 14 . . . coolant temperature sensor, 15 . . . air conditioning control section, 16 . . . airflow meter, 17 . . . valve body, 18 . . . actuator, 19 . . . spring, 20 . . . hole, 21 . . . detour passage, 22 . . . west gate valve, 23 . . . spring

The invention claimed is:

1. A cooling apparatus for a vehicle, the cooling apparatus including a first coolant circuit in which coolant circulates through an engine and a second coolant circuit in which coolant circulates without passing through the engine, the cooling apparatus comprising:

a valve that, when closed, decreases or zeroes out the flow rate of the coolant in the first coolant circuit that passes through the engine, and, when open, the valve mixes the coolant in the first coolant circuit and the coolant in the second coolant circuit;

a valve control section for closing the valve when the temperature of the coolant in the first coolant circuit is less than a half-warm-up determination value set to a value lower than a determination value for warm-up completion of the engine, the valve control section opening the valve when the temperature of the coolant in the first coolant circuit increases to the half-warm-up determination value or higher; and a determining section, wherein, when the temperature of the coolant in the first coolant circuit is greater than or equal to the half-warm-up determination value, the determining section determines that a closed valve failure has occurred in the valve if the difference between the temperature of the coolant in the first coolant circuit and the temperature of the coolant in the second coolant circuit is greater than a failure determination value.

2. The cooling apparatus for a vehicle according to claim 1, wherein, when the temperature of the coolant in the first coolant circuit is less than the half-warm-up determination value, the determining section obtains an estimate of the temperature of the coolant in the first coolant circuit based on an engine operating state since start-up initiation and obtains an actual measurement value of the temperature of the coolant in the first coolant circuit from a detection signal provided by a coolant temperature sensor for detecting the temperature of the coolant in the first coolant circuit, the determining section determining that an open valve failure has occurred in the valve if the difference between the estimate and the actual measurement value is greater than or equal to the failure determination value.

3. The cooling apparatus for a vehicle according to claim 1, further comprising:

a radiator for radiating heat from the coolant that has passed through the engine;

a thermostat that closes to prohibit circulation of the coolant through the radiator when the temperature of the coolant is less than a prescribed value, the thermostat opening to permit the circulation of the coolant in the first coolant circuit through the radiator when the temperature of the coolant is higher than or equal to the prescribed value; and a thermostat control section that forcibly opens the thermostat when it is determined that a closed valve failure has occurred in the valve.

4. The cooling apparatus for a vehicle according to claim 3, wherein, when it is determined that a closed valve failure has occurred in the valve, the thermostat control section forcibly opens the thermostat on condition that the temperature of the coolant in the first coolant circuit is higher than or equal to a valve opening value that is smaller than the prescribed value.

5. The cooling apparatus for a vehicle according to claim 1, further comprising a prohibiting section, wherein, when it is determined that a closed valve failure has occurred in the valve, the prohibiting section prohibits operation of the engine.

6. The cooling apparatus for a vehicle according to claim 5, further comprising:

a radiator for radiating heat from the coolant that has passed through the engine;

a thermostat that closes to prohibit circulation of the coolant through the radiator when the temperature of the coolant is less than a prescribed value, the thermostat opening to permit the circulation of the coolant in the first coolant circuit through the radiator when the temperature of the coolant is higher than or equal to the prescribed value; and a prohibiting section, wherein, when it is determined that a closed valve failure has occurred in the valve, the prohibiting section prohibits the operation of the engine on condition that the temperature of the coolant in the first coolant circuit is higher than or equal to the prescribed value.

7. The cooling apparatus for a vehicle according to claim 1, further comprising an electric pump arranged in the first coolant circuit to circulate the coolant in the first coolant circuit, wherein, if the discharge flow rate of the electric pump is increased to a value greater than a normal usage range, the valve allows to send the coolant of a flow rate necessary for cooling the engine even when the valve is closed, the cooling apparatus further comprising a pump control section, wherein, when it is determined that a closed valve failure has occurred in the valve, the pump control section increases the discharge flow rate of the electric pump to a value greater than the normal usage range.

8. The cooling apparatus for a vehicle according to claim 1, further comprising:

an electric pump arranged in the first coolant circuit to circulate the coolant in the first coolant circuit;

a detour passage arranged in the first coolant circuit in such a manner as to detour the valve;

a west gate valve that is opened to send the coolant of the flow rate necessary for cooling the engine via the detour passage when the discharge flow rate of the electric pump is increased to a value greater than a normal usage range; and a pump control section, wherein, when it is determined that a closed valve failure has occurred in the valve, pump control section increases the discharge flow rate of the electric pump to a value greater than the normal usage range.

9. A cooling apparatus for a vehicle, the cooling apparatus including a first coolant circuit in which coolant circulates through an engine and a second coolant circuit in which coolant circulates without passing through the engine, the cooling apparatus comprising:

a valve that, when closed, decreases or zeroes out the flow rate of the coolant in the first coolant circuit that passes through the engine, and, when open, the valve mixes the coolant in the first coolant circuit and the coolant in the second coolant circuit;

a first coolant temperature sensor for detecting the temperature of the coolant in the first coolant circuit;

a second coolant temperature sensor for detecting the temperature of the coolant in the second coolant circuit; and a valve control section for closing the valve when the temperature of the coolant in the first coolant circuit is less than a half-warm-up determination value set to a value lower than a determination value for warm-up completion of the engine, the valve control section opening the valve when the temperature of the coolant in the first coolant circuit increases to the half-warm-up determination value or higher, wherein, if a failure has occurred in one of the first coolant temperature sensor and the second coolant temperature sensor, the valve control section opens the valve to mix the coolant in the first coolant circuit with the coolant in the second coolant circuit.

10. A cooling apparatus for a vehicle, the cooling apparatus including a first coolant circuit in which coolant circulates through an engine and a second coolant circuit in which coolant circulates without passing through the engine, the cooling apparatus comprising:

a valve that, when closed, decreases or zeroes out the flow rate of the coolant in the first coolant circuit that passes through the engine, and, when open, the valve mixes the coolant in the first coolant circuit and the coolant in the second coolant circuit;

a coolant temperature sensor for detecting the temperature of the coolant in one of the first coolant circuit and the second coolant circuit;

a coolant temperature estimating section for estimating the temperature of the coolant in the other one of the first coolant circuit and the second coolant circuit; and a valve control section for closing the valve when the temperature of the coolant in the first coolant circuit is less than a half-warm-up determination value set to a value lower than a determination value for warm-up completion of the engine, the valve control section opening the valve when the temperature of the coolant in the first coolant circuit increases to the half-warm-up determination value or higher, wherein, if a failure has occurred in the coolant temperature sensor, the valve control section opens the valve to mix the coolant in the first coolant circuit and the coolant in the second coolant circuit.

* * * * *